US011076652B2

(12) United States Patent
Fiedler et al.

(10) Patent No.: US 11,076,652 B2
(45) Date of Patent: Aug. 3, 2021

(54) CLOSURE DEVICE FOR THE RELEASABLE CONNECTING OF TWO PARTS

(71) Applicant: Fidlock GmbH, Hannover (DE)

(72) Inventors: Joachim Fiedler, Hannover (DE); Breido Botkus, Hannover (DE); Philip Klein, Hannover (DE)

(73) Assignee: Fidlock GmbH, Hannover (DE)

( * ) Notice: Subject to any disclaimer, the term of this patent is extended or adjusted under 35 U.S.C. 154(b) by 0 days.

(21) Appl. No.: 16/008,515

(22) Filed: Jun. 14, 2018

(65) Prior Publication Data

US 2018/0360147 A1 Dec. 20, 2018

(30) Foreign Application Priority Data

Jun. 16, 2017 (DE) ..... 10 2017 210 140.7

(51) Int. Cl.

| | |
|---|---|
| ***A41F 1/00*** | (2006.01) |
| ***A41B 1/10*** | (2006.01) |
| ***A43C 11/00*** | (2006.01) |
| ***A44B 13/00*** | (2006.01) |
| ***A45C 13/10*** | (2006.01) |
| ***A44B 11/25*** | (2006.01) |
| *A44C 5/20* | (2006.01) |

(52) U.S. Cl.

CPC ..... *A41F 1/002* (2013.01); *A41B 1/10* (2013.01); *A43C 11/00* (2013.01); *A44B 11/258* (2013.01); *A44B 13/0052* (2013.01); *A45C 13/1069* (2013.01); *A44C 5/2071* (2013.01); *A44D 2203/00* (2013.01); *Y10T 24/32* (2015.01)

(58) Field of Classification Search

CPC ... A41F 1/002; A44B 11/258; A44B 13/0052; A45C 13/1069; A43C 11/00; A41B 1/10; A44C 5/2071; A44D 2203/00; Y10T 24/32; H01F 7/0263

See application file for complete search history.

(56) References Cited

U.S. PATENT DOCUMENTS 2,389,298 A * 11/1945 Ellis ..... A41F 1/002 335/303
2,615,227 A * 10/1952 Hornik ..... A44C 5/2071 24/303
2,959,832 A * 11/1960 Baermann ..... A45C 13/1069 24/303

(Continued)

FOREIGN PATENT DOCUMENTS

CN 1062615 A 7/1992
CN 1084929 A 4/1994

(Continued)

*Primary Examiner* — Robert Sandy
*Assistant Examiner* — Rowland Do
(74) *Attorney, Agent, or Firm* — The Webb Law Firm

(57) ABSTRACT

Provided is a closure device for the releasable connecting of two parts to each other including a first closure part, having a first base body, at least two first engaging sections formed on the first base body, spaced apart from each other along a loading direction and forming between them a gap, and at least one first magnetic section arranged on the first base body, and a second closure part, having a second base body, at least one second engaging section formed on the second base body, and at least one second magnetic section arranged on the second base body.

15 Claims, 19 Drawing Sheets

(56) References Cited

U.S. PATENT DOCUMENTS

| | | | | |
|---|---|---|---|---|
| 3,102,314 | A * | 9/1963 | Alderfer | A41F 1/002 24/303 |
| 4,183,121 | A * | 1/1980 | Cousins | A44B 13/0023 24/588.1 |
| 4,399,595 | A | 8/1983 | Yoon et al. | |
| 4,941,236 | A | 7/1990 | Sherman et al. | |
| 5,274,889 | A | 1/1994 | Morita | |
| 6,301,754 | B1 * | 10/2001 | Grunberger | A41F 1/002 24/303 |
| 7,320,158 | B2 | 1/2008 | Deto et al. | |
| 9,392,846 | B2 | 7/2016 | Shirai | |
| 2004/0016089 | A1 * | 1/2004 | Grunberger | A41F 1/002 24/303 |
| 2004/0107547 | A1 | 6/2004 | Chung | |
| 2007/0277353 | A1 | 12/2007 | Kondo et al. | |
| 2012/0060330 | A1 * | 3/2012 | Fildan | A41F 1/002 24/303 |
| 2012/0117764 | A1 * | 5/2012 | Wong | A41F 1/002 24/302 |
| 2012/0174346 | A1 * | 7/2012 | Fildan | A41F 1/002 24/303 |
| 2016/0073744 | A1 | 3/2016 | Fiedler et al. | |
| 2016/0307680 | A1 * | 10/2016 | Provencher | H01F 7/0263 |
| 2017/0073744 | A1 | 3/2017 | Chun et al. | |
| 2018/0146730 | A1 * | 5/2018 | Fildan | A44B 13/0076 |

FOREIGN PATENT DOCUMENTS

| | | | |
|---|---|---|---|
| CN | 104768413 | A | 7/2015 |
| DE | 3416798 | A1 | 11/1985 |
| DE | 3417489 | A1 | 11/1985 |
| DE | 102007024118 | A1 | 12/2007 |
| DE | 202009006189 | U1 | 10/2010 |
| EP | 0922399 | A2 | 6/1999 |
| WO | 2014180512 | A1 | 11/2014 |
| WO | 2016125229 | A1 | 7/2017 |
| WO | 2017125229 | A1 | 7/2017 |

* cited by examiner 1
2
3
21
26
27
31
A
A
x
y
z
x'
y'
z'

1
2
3
20
21
22
23
24
25
26
27
30
31
33
34
35
36
37
231
241
251
271
331
371
341
N
S

CLOSURE DEVICE FOR THE RELEASABLE CONNECTING OF TWO PARTS

CROSS-REFERENCE TO RELATED APPLICATION

This application claims priority to German Patent Application No. 10 2017 210 140.7 filed Jun. 16, 2017, the disclosure of which is hereby incorporated in its entirety by reference.

BACKGROUND OF THE INVENTION

Field of the Invention

The invention relates to a closure device for the releasable connecting of two parts to each other.

Description of Related Art

Such a closure device comprises a first closure part, having a first base body, at least two first engaging sections formed on the first base body, and at least one first magnetic section arranged on the first base body. The at least two first engaging sections are spaced apart from each other along a loading direction and form between them a gap. A second closure part can be mounted on the first closure part, having a second base body, at least one second engaging section formed on the second base body, and at least one second magnetic section arranged on the second base body. When the first closure part and the second closure part are placed against each other, the at least one second engaging section is received at least partly by the gap in a closed position such that a load acting between the first closure part and the second closure part along the loading direction is braced.

The placing of the closure parts against each other and their holding in the closed position is magnetically assisted herein by the magnetic attraction of the magnetic sections of the closure parts.

Such a closure device may be used for example on articles of clothing, such as a shoe, a shirt, a jacket or the like, but it can also be used for example on a handbag or the like. It is desirable here to be able to affix the closure device in variable fashion without the closure device notably impairing the wearing comfort of a user, for example.

Such a closure device should be easy to close and also easy to open again, but in the closed position it should be able to absorb loads in the shearing direction, i.e., along the loading direction, so that the parts joined together by the closure device cannot be easily released from each other on account of the loading.

SUMMARY OF THE INVENTION

The problem which the present invention proposes to solve is to provide a closure device for the releasable connecting of two parts which can be used in variable fashion, for example on articles of clothing, such as a shoe, a shirt or a jacket or the like, or also for the connecting of other parts.

This problem is solved by a closure device with features as described herein.

Accordingly, the first base body and/or the second base body are made at least partly from a flexible material.

Because the first base body and/or the second base body are made at least partly from a flexible material, the first base body and/or the second base body may be arranged variably on a mating part, optionally with variable adapting to the shape of the part.

By a flexible material is understood in this context a material that provides an elastic, flexible deformability on the first base body and/or the second base body, so that the first base body and/or the second base body at least in the sections that are made of the flexible material can be flexibly adapted in their shape.

The use of a flexible material furthermore has effects on the holding of the closure parts against each other. Thus, by using a flexible material it is possible to provide an advantageous (adhesive) friction between the engaging sections of the closure parts in the closed position, assuring a firm holding of the closure parts against each other.

The use of a flexible material may also make the closure device easy to open and easy to close.

Preferably, the at least two first engaging sections of the first base body and/or the at least one second engaging section of the second base body are made from the flexible material. In addition, or alternatively, an intermediate section of the first base body between the at least two first engaging sections of the first base body can be made of a flexible material.

If the engaging sections are made of a flexible material, a deformability is produced at the engaging sections. If an intermediate section between two adjacent engaging sections is made of a flexible material, a deformability is produced for the base body of the closure part, especially for a curvature viewed along the loading direction.

The flexible material can be, for example, a thermoplastic elastomer, especially a thermoplastic polyurethane (TPU, for short), or a synthetic rubber material, especially acrylonitrile-butadiene rubber (NBR, for short).

The flexible material may comprise a fiber fraction, such as a fraction of glass fibers, advantageously with a fraction of less than 15 wt. percent (wt. % in terms of the total weight of the material).

In one embodiment, the at least two first engaging sections and/or the at least one second engaging section extend in the form of webs transversely to the loading direction. Thanks to the engaging of the at least one second engaging section in the gap between two adjacent first engaging sections, a bracing is thus created against the loading direction, by virtue of which the closure parts are held against one another in the closed position. The at least one second engaging section is herein preferably received with form fit in the gap between two adjacent first engaging sections and, supported by the magnetic attraction between the magnetic sections of the closure parts, held between the adjacent first engaging sections, there being possibly an (adhesive) friction between the engaging sections ensuring a holding of the closure parts against each other even under relatively large loads and possibly a deformation at the base bodies due to the loading.

The engaging sections in the form of the webs may extend in a straight line transversely to the loading direction. However, it is also conceivable and possible for the engaging sections in the form of the webs to extend in curved manner on the respective base body.

Thanks to the magnetic sections of the closure parts, a magnetic attraction is produced between the closure parts when placed on each other and in the closed position. The magnetic sections in this case can be implemented in various ways.

In a first embodiment, discrete magnet elements are arranged on the base bodies of the closure parts, for example each of them in the form of permanent magnet elements or in the form of permanent magnet elements on the one hand and in the form of magnetic anchors (made of a ferromagnetic material), on the other hand.

In an alternative embodiment, the magnetic sections may also be produced by magnetization of the first base body and/or of the second base body in portions. In this case, the magnetic sections are formed as a single piece with the base body in that the base bodies are made of a magnetic material or comprise a magnetic material and are magnetized at least for a portion in order to provide a magnetic effect.

One or more magnetic sections may be arranged on each base body, for example in the form of discrete magnet elements.

In one advantageous embodiment, a magnetic section can be assigned for example to the two first engaging sections on the first base body and the at least one second engaging section of the second base body. In particular, a discrete magnet element can be arranged in each engaging section, so that a magnetic action occurs immediately at and between the engaging sections.

Alternatively, one magnetic section may also be arranged in the area of the gap between two adjacent first engaging sections on the base body of the first closure part. In this case, for example, a discrete magnet element is arranged beneath the gap in the base body of the first closure part. A magnetic effect then occurs in the area of the gap, but not directly at the engaging sections of the first closure part.

The magnetic sections can be magnetized in different ways.

In one embodiment, the at least one first magnetic section of the first closure part and/or the at least one second magnetic section of the second closure part are magnetized along a direction of magnetization which is collinear with the loading direction. North poles and south poles of the magnetic sections are thus set off from one another along the loading direction. Especially if the magnetic sections are formed directly on the engaging sections a magnetic attraction will result in the closed position between the first engaging sections of the first closure part and a second engaging section of the second closure part along a direction oriented collinear with the loading direction. In this way, for example, an advantageous (adhesive) friction may be established between the engaging sections.

In an alternative embodiment, the magnetic sections may also be magnetized perpendicular to the loading direction, especially along a closing direction, along which the closure parts are placeable against one another for the closing of the closure device. In this case, the magnetic attraction acts especially along the closing direction. Such a magnetization may be advantageous, e.g., when the magnetic sections of the first closure part are arranged underneath the gaps between the first engaging sections.

In one embodiment, the at least one second engaging section has a bearing surface, which in the closed position is in abutment with one of the at least two first engaging sections of the first closure part for the bracing of a loading acting in the loading direction on the second closure part. Thanks to the bearing surface, an (adhesive) friction is produced between the second engaging section of the second closure part and the mating first engaging section of the first closure part, by virtue of which the closure parts are also held reliably against one another under loading, so that the closure parts cannot be easily separated from each other on account of the loading.

In one embodiment, the bearing surface is inclined to the loading direction and to the closing direction, along which the closure parts may be placed against each other, such that, under a loading against the second closure part in the loading direction, the at least one second engaging section is loaded with a force component in the closing direction relative to the first closure part. The engagement between the engaging sections of the closure parts is thus self-reinforcing under loading. Thanks to the inclination of the bearing surface, a force component (produced by vector decomposition) acts, under loading in the loading direction, in the closing direction and thus in the direction of an engagement of the second engaging section of the second closure part in the gap between adjacent first engaging sections of the first closure part.

Preferably, the engaging sections of the first closure part each have a complementary bearing surface to the bearing surface of the second engaging section of the second closure part, so that in the closed position a flat abutment exists between the mating bearing surfaces.

In particular, the engaging sections of the first closure part and the second closure part each have a basic shape in cross section corresponding to the shape of a non-rectangular parallelogram.

In addition or alternatively, an undercut may also be formed between the engaging sections, holding the engaging sections against one another in the closing direction in the closed position.

In one embodiment, the first base body and/or the second base body are curved, viewed along the loading direction. In a plane subtended by the loading direction and the closing direction the first base body and/or the second base body are thus curved in an arc, for example. Thanks to a predetermined curvature (which may exist for example in a starting position with the closure device non-loaded and no deformation of the respective base body), the closure parts of the closure device may be preshaped, e.g., so that they can be arranged in favorable manner on parts to be joined together.

If the closure device is supposed to be used on a shoe, for example, the base bodies of the closure parts of the closure device may be preshaped so as to be adapted to the configuration of the shoe.

In one embodiment, the first base body is connectable to a first part and the second base body to a second part. The first base body may comprise herein a first fastening section, by which the first base body is to be connected to the first part, wherein the first fastening section defines a plane extending along the loading direction, relative to which a bottom of the gap is recessed. In addition or alternatively, the second base body may comprise a second fastening section, by which the second base body is to be connected to the second part, wherein the second fastening section defines a plane extending along the loading direction, relative to which a bottom adjoining the at least one second engaging section is recessed.

In this case, e.g., the gaps between the first engaging sections of the first base body can be formed as depressions in the first base body. Via the fastening section, a textile segment of an article of clothing may be connected to the base body, for example by stitching or gluing, so that the engaging sections of the first base body do not project outward beyond the fastening section of the article of clothing. In addition or alternatively, a fastening section may also define a plane on the second base body of the second closure part for the fastening on the second part, for example a textile segment, beyond which the at least one second engaging section does not project outwardly.

It is also conceivable and possible to recess the bottom of the gap of the first base body and the bottom of the second base body adjoining the second engaging section with regard to the respective fastening section, in which case the engaging sections are each partly sunken in the base body, yet still project outward beyond the fastening section, for example by half their height.

The problem is also solved by a closure device for the releasable connecting of two parts to each other, with a first closure part, having a first base body, at least two first engaging sections formed on the first base body, spaced apart from each other along a loading direction and forming between them a gap, and at least one first magnetic section arranged on the first base body, and a second closure part, having a second base body, at least one second engaging section formed on the second base body, and at least one second magnetic section arranged on the second base body, wherein the first closure part and the second closure part are placeable against each other such that, in a closed position, the at least one second engaging section is received at least partly by the gap for the bracing of a loading acting between the first closure part and the second closure part along the loading direction, wherein in the closed position the at least one first magnetic section and the at least one second magnetic section interact by magnetic attraction. It is proposed here that the first base body and/or the second base body are curved, viewed along the loading direction.

Furthermore, the problem is also solved by a closure device for the releasable connecting of two parts to each other, with a first closure part, having a first base body, at least two first engaging sections formed on the first base body, spaced apart from each other along a loading direction and forming between them a gap, and at least one first magnetic section arranged on the first base body, and a second closure part, having a second base body, at least one second engaging section formed on the second base body, and at least one second magnetic section arranged on the second base body, wherein the first closure part and the second closure part are placeable against each other such that, in a closed position, the at least one second engaging section is received at least partly by the gap for the bracing of a loading acting between the first closure part and the second closure part along the loading direction, wherein in the closed position the at least one first magnetic section and the at least one second magnetic section interact by magnetic attraction. It is provided here that the first base body is connectable to a first part and the second base body to a second part, wherein the first base body comprises a first fastening section, by which the first base body is to be connected to the first part, wherein the first fastening section defines a plane extending along the loading direction, relative to which a bottom of the gap is recessed, and/or the second base body comprises a second fastening section, by which the second base body is to be connected to the second part, wherein the second fastening section defines a plane extending along the loading direction, relative to which a bottom adjoining the at least one second engaging section is recessed.

The benefits and advantageous embodiments such as have been described above are also applicable to these two closure devices, so that one should refer in full to the previous remarks. Closure devices of the above described kind may be used in particular on an article of clothing, such as a shoe, a jacket, a shirt or the like. Furthermore, it is also conceivable to use a closure device of the described kind on a prosthesis, an orthesis, or another medical aid. However, this should not be taken in a limiting fashion. A closure device of the described kind may basically be used for the connecting of any desired parts to each other.

BRIEF DESCRIPTION OF THE DRAWINGS

The basic idea of the invention shall be explained more closely below with the aid of sample embodiments represented in the figures.

DESCRIPTION OF THE INVENTION

FIGS. 1A to 1I show various front views of a first sample embodiment of a closure device 1 with engaging sections 21, 31 as well as form fit sections 23, 33. Such a closure device 1 can generally be provided for the releasable connecting of two parts to each other. For example, such a closure device 1 may be arranged on an article of clothing or on a handbag.

Figure 1A:
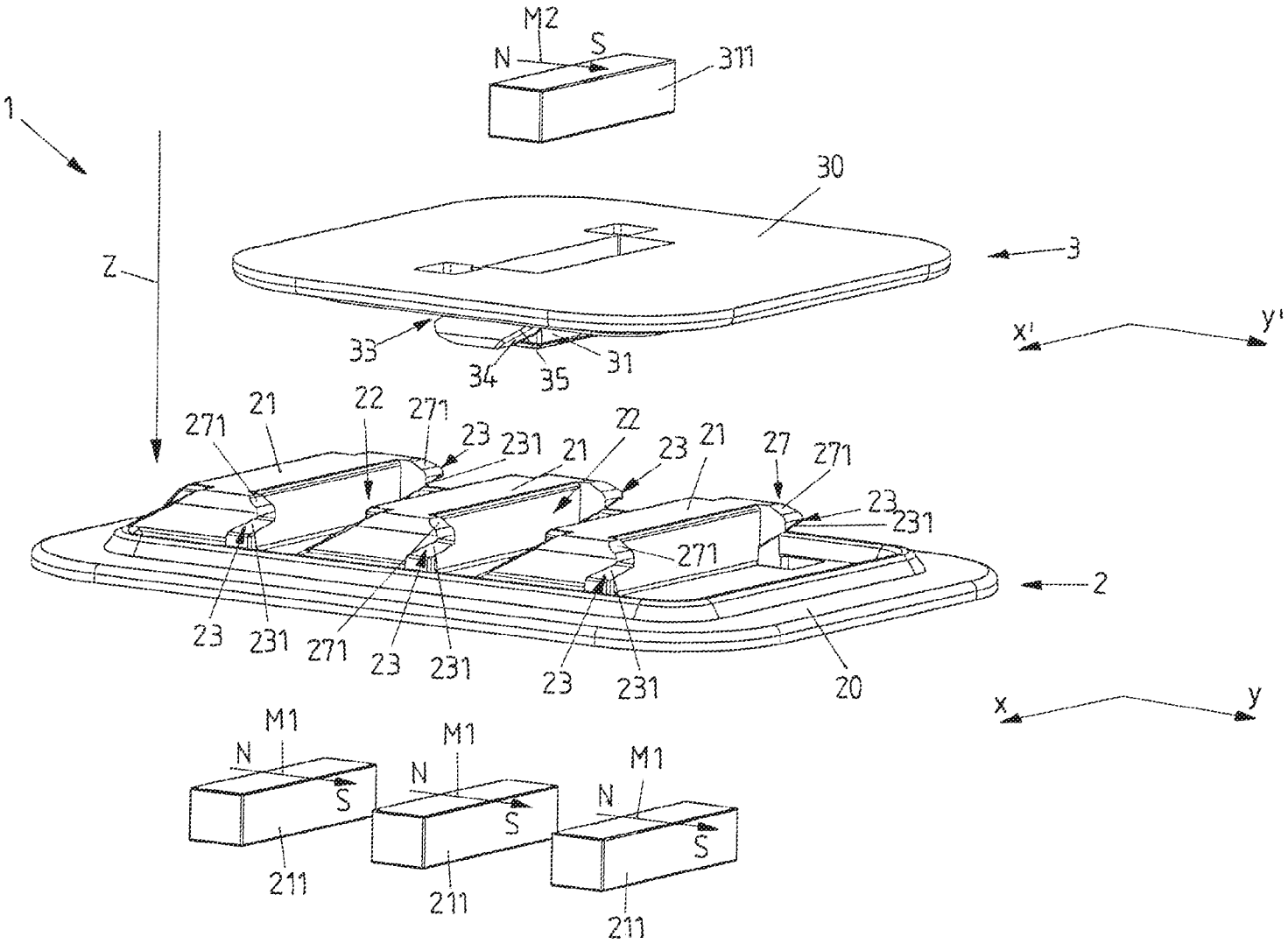
FIG. 1A a perspective exploded view of a sample embodiment of a closure device with engaging sections and form fit sections.

As is shown for example in FIG. 1A, the closure device 1 comprises a first closure part 2 and a second closure part 3, the two closure parts 2, 3 being able to be placed one against the other for the closing of the closure device 1 along a closing direction Z. Each closure part 2, 3 comprises a base body 20, 30, which extends substantially in a respective plane of extension XY, X'Y'.

On the base body 20 of the first closure part 2 are arranged three first engaging sections 21, every two adjacent engaging sections 21 being spaced apart from each other and forming a gap 22 between them. A second engaging section 31 is arranged on a side of the base body 30 of the second closure part 3 facing toward the first engaging sections 21.

In the exploded representation of FIG. 1A it becomes clear that every first engaging section 21 comprises a first permanent magnet 211 with a first direction of magnetization M1, wherein the first direction of magnetization M1 points from a North pole N to a South pole S of the respective first permanent magnet 211. Accordingly, the second engaging section 31 also comprises a second permanent magnet 311 with a second direction of magnetization M2, which points from a North pole N to a South pole S of the second permanent magnet 311. During use of the closure device 1, the permanent magnets 211, 311 are arranged in specifically provided recesses of the first engaging sections 21 and the second engaging section 31, respectively.

Figure 1B:
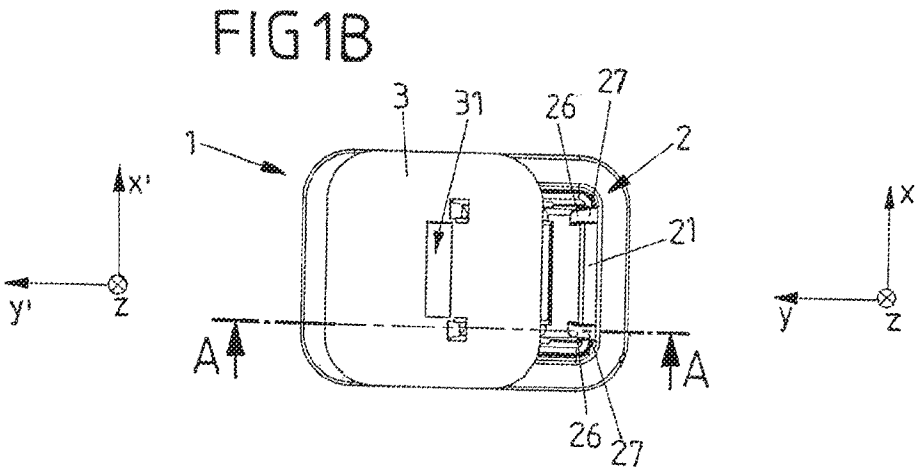
FIGS. 1B-1I front views and cross-sectional views of the closure device from FIG. 1A.
Figure 1C:
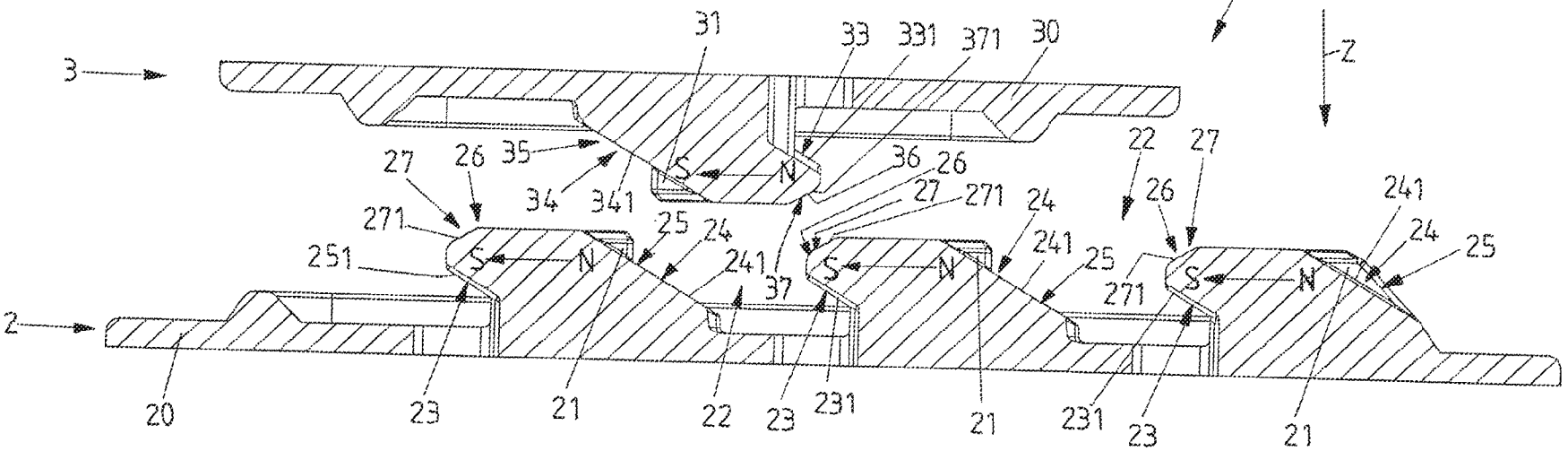
Figure 1D:
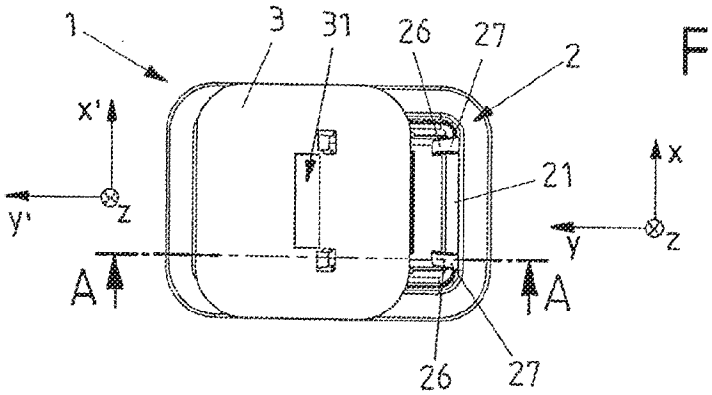
Figure 1E:
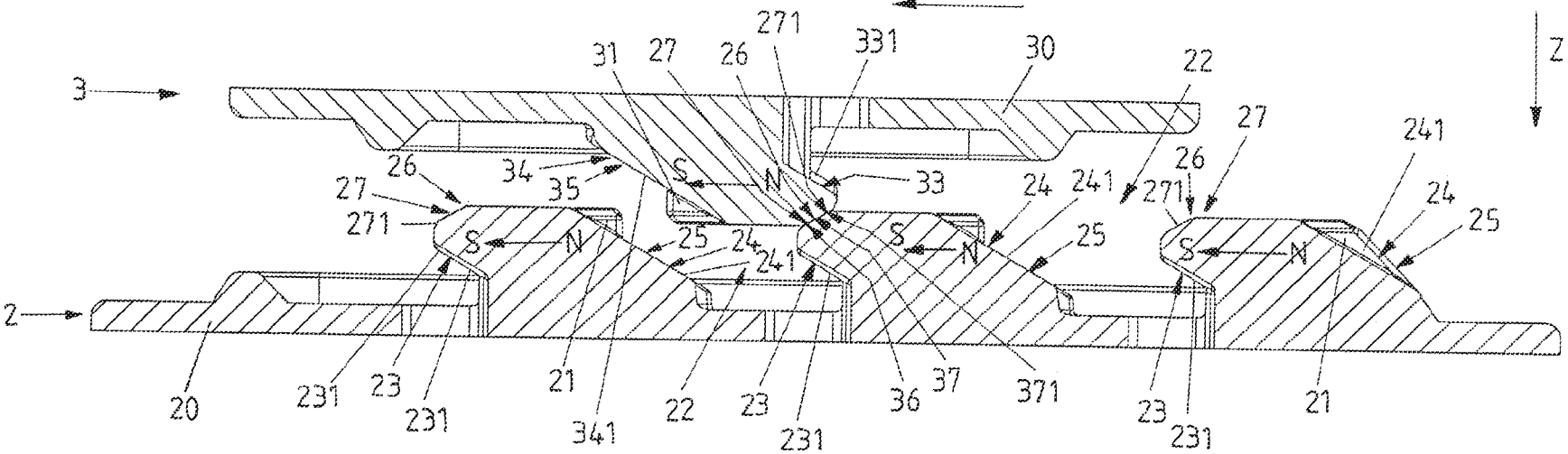
Figure 1F:
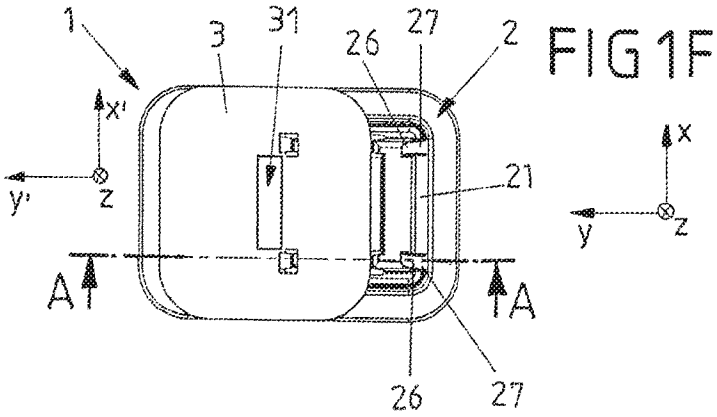
Figure 1G:
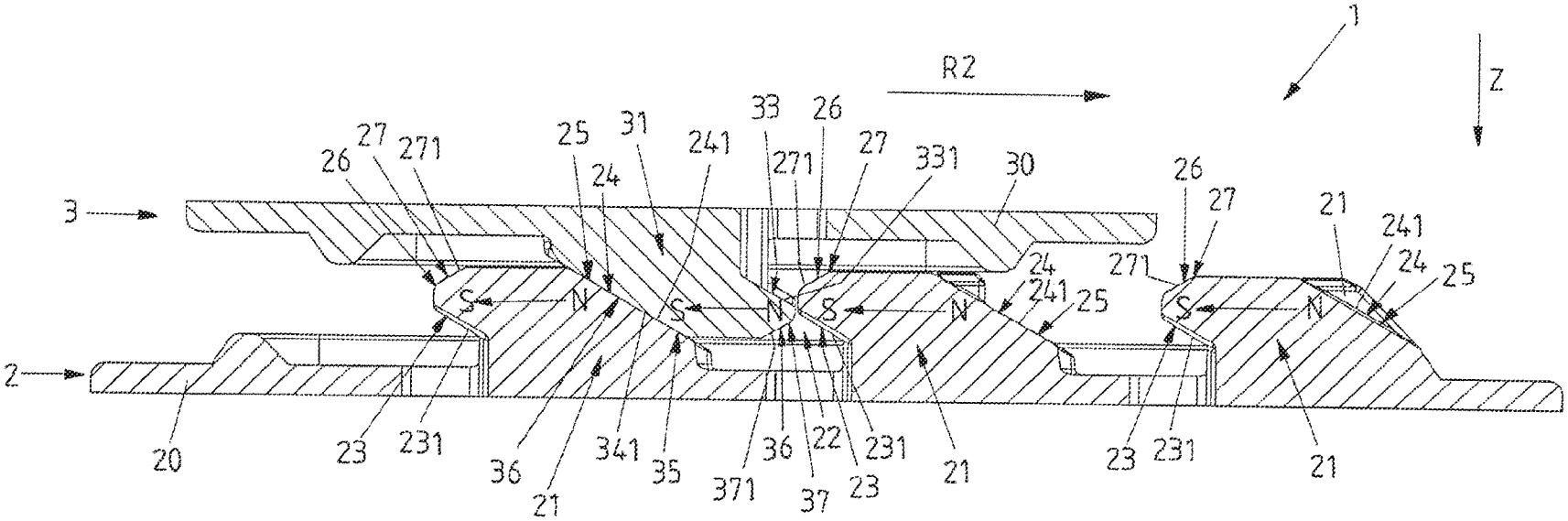
Figure 1H:
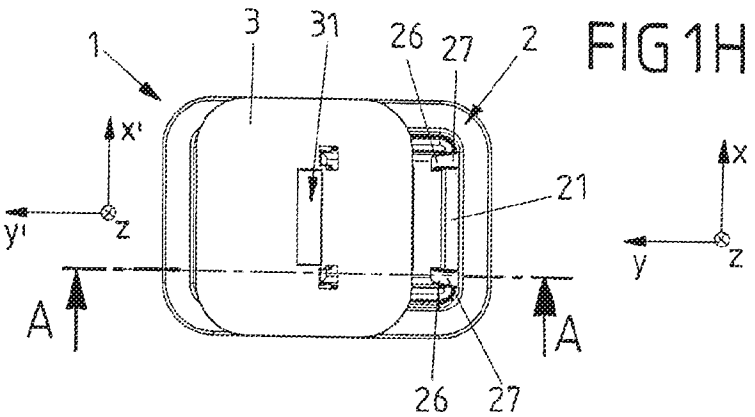
Figure 1I:
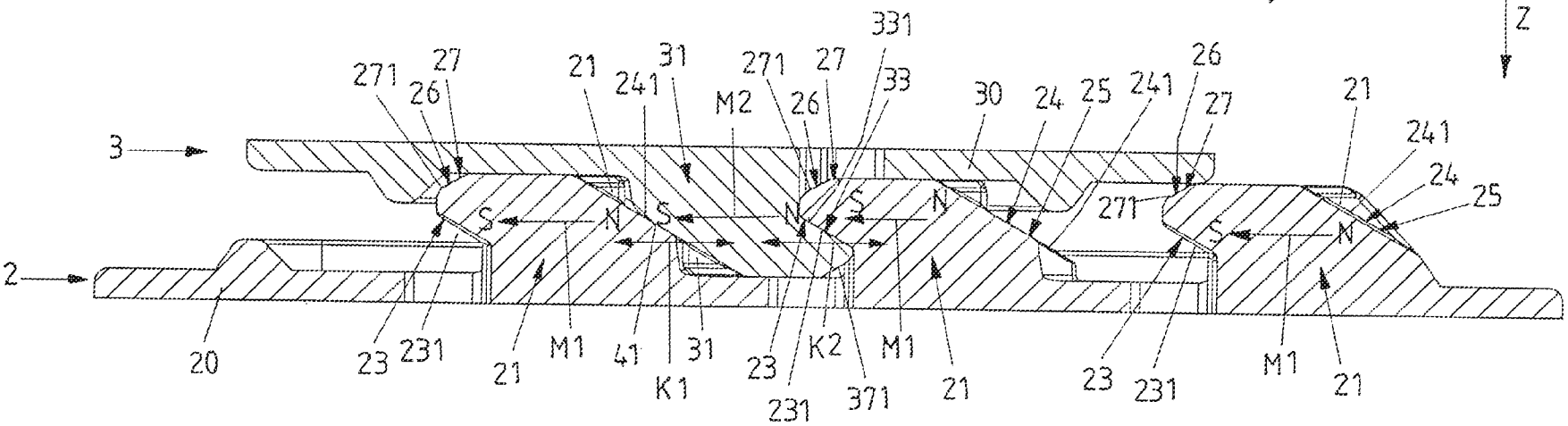

For the closing of the closure device 1, the first closure part 2 and the second closure part 3 are placeable against each other along the closing direction Z such that the closure device 1 takes up a closed position as represented in FIG. 1I. Here, the respective planes of extension XY, X'Y' of the base bodies 20, 30 of the first closure part 2 and the second closure part 3 in the closed position extend substantially parallel to each other and perpendicular to the closing direction Z.

It becomes clear with the aid of FIG. 1I that the second engaging section 31 in the closed position is received by one of the gaps 22 formed between adjacent second engaging sections 21. Each time an attracting magnetic force K1, K2, being oriented substantially perpendicular to the closing direction Z, is acting between the second engaging section 31 on the one hand and each of the two first engaging sections 21 forming the gap 22 on the other hand, in accordance with the mutually facing orientation of the North and South poles N, S. The attractive magnetic forces K1, K2 oriented perpendicular to the closing direction Z hold the closure device 1 securely in its closed position.

In order to create the attractive magnetic forces K1, K2 in the closed position, the permanent magnets 211, 311 are arranged in the respective engaging sections 21, 31 such that the first direction of magnetization M1 and the second direction of magnetization M2 run parallel to each other and are oriented substantially perpendicular to the closed position Z. The directions of magnetization M1, M2 as well as the attracting magnetic forces K1, K2 in the closed position run substantially parallel to the planes of extension XY, X'Y' of the base bodies 20, 30.

FIG. 1B to 1I, which shall be discussed more closely below, illustrate as an example one possible closing process of the closure device 1. FIGS. 1B, 1D, 1F and 1H each represent a front view of the closure device 1 of FIG. 1A in, and FIGS. 1C, 1E, 1G and 1I show corresponding cross-sectional representations along the respective sectioning line A-A.

In FIGS. 1B and 1C, an opened state of the closure device 1 is represented. On the contrary, FIGS. 1H and 1I illustrate a closed position of the closure device 1. Possible intermediate positions which the closure device 1 can take up during a closing process are represented in FIG. 1D to 1G.

In addition to the engaging sections 21, the first closure part 2 comprises six form fit sections 23, every two of which enclose an engaging section 21 at the side, and each of them having a form fit surface 231 which is slanting to the closing direction. The three form fit sections 23, similar to the engaging sections 21, are arranged at a regular spacing from each other on the base body 20 of the first closure part 2. Likewise, the second closure part 3 comprises two form fit sections 33 complementary to the first form fit sections 23, which enclose the second engaging section 31 at the side and have a form fit surface 331 which is slanting to the closing direction Z.

The first form fit sections 23 on the one hand and the second form fit sections 33 on the other hand are provided and arranged so as to stand in form fitting engagement with each other in the closed position of the closure device 1, so as to prevent a relative movement of the closure parts 2, 3 relative to each other and oriented against the closing direction Z, by which the closure parts 2, 3 would be separated from each other. In other words, the form fit sections 23, 33 of the first closure part 2 on the one hand and of the second closure part 3 on the other hand engage behind each other in the closed position with form fitting in regard to the closing direction Z, see FIG. 1I. For this purpose, the slanted form fit surfaces 231 of the first form fit sections 23 are facing toward the base body 20 of the first closure part 2. The form fit surfaces 331 of the second form fit sections 33 are accordingly facing toward the base body 30 of the second closure part 3.

The form fitting engagement of the two closure parts 2, 3 by means of the form fit sections 23, 33 allows a secure connection in the closed position of the closure device 1. An unintentional opening of the closure device 1 by a relative movement of the closure parts 2, 3 against the closing direction Z, by which the two closure parts 2, 3 would be separated from each other, can thus be prevented. Furthermore, thanks to the form fitting of the form fit sections 23, 33 with each other, external shear forces which may be acting perpendicular to the closing direction Z on the closure parts 2, 3 can be absorbed.

In another variant (not represented), the first form fit sections 23 and/or the second form fit sections 33 may be formed by a "real" mechanical undercut on the respective closure part 2, 3, wherein the first form fit sections 23 and/or the second form fit sections 33 each have at least one form fit surface running substantially perpendicular to the closing direction Z.

Moreover, respective first guiding sections 24, 34 are provided on the two closure parts 2, 3. The first guiding sections 24, 34 in the sample embodiment shown are formed as first guiding surfaces 241, 341 on the form fit sections 23, 33, slanting in the closing direction Z and surrounding the first engaging sections 21, 31 at the sides.

As is illustrated for example in FIG. 1G, the first guiding sections 24, 34 are designed to provide a mutual relative movement R2 of the closure parts 2, 3 oriented perpendicular to the closing direction Z when the closure parts 2, 3 are placed against each other, in order to bring the at least one first form fit section 23 and the at least one second form fit section 33 into form fitting engagement with each other, corresponding to the closed position represented in FIG. 1I.

For this purpose, the first guiding surfaces 241 of the first closure part 2 respectively form a first bearing section 25 for sliding on the first guiding surfaces 341 of the second closure part 3. By the same token, the first guiding surfaces 341 of the second closure part 3 respectively form a first bearing section 35 for sliding on the first guiding surfaces 241 of the first closure part.

For example, when the second closure part 3 is mounted on the first closure part 2, the second closure part 3 can slide by its first bearing sections 35 on the first guiding surfaces 241 of the first closure part 2 along the closing direction Z and in this way it can be deflected perpendicular to the closing direction Z (corresponding to the relative movement R2 indicated in FIG. 1G) such that the form fit surfaces 231, 331 of the first closure part 2 and the second closure part 3 come into form fitting engagement with each other in order to prevent a relative movement oriented parallel to the closing direction Z, by which the closure parts 2, 3 would be separated from each other.

In this process, the second closure part 3 when sliding on the first guiding surfaces 241 of the first closure part 2 is loaded with a shear force applied perpendicular to the closing direction Z, bringing about the deflecting of the movement and the resulting relative movement R2 into the closed position. This process corresponds to the step from the intermediate position represented in FIG. 1G of the closure device 1 to the closed position shown in FIG. 1I.

In this way, an especially simple closing process is made possible, since a user only needs to place the closure parts 2, 3 against each other roughly along the closing direction Z. The form fitting interlocking of the form fit sections 23, 33 with each other then occurs almost automatically by the shear force produced by means of the guiding surfaces 241, 341 or by means of the bearing sections 25, 35 and the resulting relative movement R of the second The magnetic attraction between the engaging sections 21, 31 additionally assists in the closing process.

As shown in FIG. 1I, in the closed position the first engaging sections 21 and the engaging section 31 are arranged in succession and collinear with the effective direction of the shear force occurring to take up the closed position, i.e., the direction of the relative movement R2. The first direction of magnetization M1 of the first permanent magnets 211 arranged in the first engaging sections 21 and the second direction of magnetization M2 of the second permanent magnet 311 arranged in the second engaging section 31 are directed parallel to each other and substantially perpendicular to the closing direction Z. As regards the first direction of magnetization M1 and the second direction of magnetization M2, the first engaging sections 21 and the second engaging section 31 are arranged one behind the other.

The attracting magnetic forces K1, K2 directed accordingly perpendicular to the closing direction Z then also hold the closure device 1 in its closed position when the closure parts 2, 3 are subjected to an external shear force acting against the relative movement R2, as long as the external shear force does not surpass the magnetic forces K1, K2. In this way, an unintentional opening of the closure device 1 can be prevented. On the other hand, external shear forces acting in the direction of the relative movement R2 on the closure parts 2, 3 can be absorbed by the form fitting engagement of the form fit sections 23, 33 in the closed position.

In addition to the first guiding sections 24, 34, respective second guiding sections 27, 37 are provided on the two closure parts 2, 3. The second guiding sections 27, 37 herein are also formed as two guiding surfaces 271, 371 on the form fit sections 23, 33, slanting toward the closing direction Z, and enclosing the engaging sections 21, 31 at the sides.

The function of the second guiding sections 27, 37 becomes clear from the step from the intermediate position shown in FIG. 1E to the intermediate position shown in FIG. 1G. Accordingly, the second guiding sections 27, 37 are designed to produce, when the closure parts 2, 3 are placed against one another, at first a first relative movement R1 of the closure parts 2, 3 toward each other, oriented perpendicular to the closing direction Z, in order to bring into mutual abutment the first guiding sections 24 of the first closure part 2 on the one hand and the first guiding sections 34 of the second closure part 3 on the other hand (see FIG. 1G).

For this purpose, the second guiding surfaces 271 of the first closure part 2 respectively form a second bearing section 26 for sliding on the second guiding surfaces 371 of the second closure part 3. By the same token, the second guiding surfaces 371 of the second closure part 3 respectively form a second bearing section 36 for sliding on the second guiding surfaces 271 of the first closure part.

For example, the second closure part 3 in a first step can slide by its second bearing sections 36 on the second guiding surfaces 271 of the first closure part 2 and in this way be deflected perpendicular to the closing direction Z (corresponding to the first relative movement R1 shown in FIG. 1E) such that the first guiding surfaces 241, 341 of the first closure part 2 and of the second closure part 3 come to abut against each other (see FIG. 1G).

In a second step, the second closure part 3, as was already described above in regard to FIGS. 1G and 1I, may then be pushed along the first guiding section 24 in a second relative movement R2 in the direction of the form fit section 23 of the first closure part 2 in order to come into form fitting engagement with it and thus produce the closed position of the closure device 1. The second relative movement R2 is here oriented opposite the first relative movement R1.

Thanks to the described interplay of the second guiding sections 27, 37 and the first guiding sections 24, 34, a certain tolerance is ensured when placing the closure parts 2, 3 against each other, which simplifies the closing of the closure device 1 for a user. Thus, the user need not worry about lining up the two closure parts 2, 3 exactly in the area of their first guiding sections 27, 37.

Of course, it is also possible when placing the closure parts 2, 3 against one another for the first closure part 2 to come directly into abutment with the first guiding section 34 of the other closure part 3, without having been first deflected at the second guiding section 37. The mounting may occur here in the area of the entire width of the first guiding sections 24, 34, so that a particularly accurate mounting is not required. The first guiding sections 24, 34 thus also contribute in themselves to a tolerance in the mounting movement and therefore to an especially easy closing process of the closure device 1.

Figure 2A:
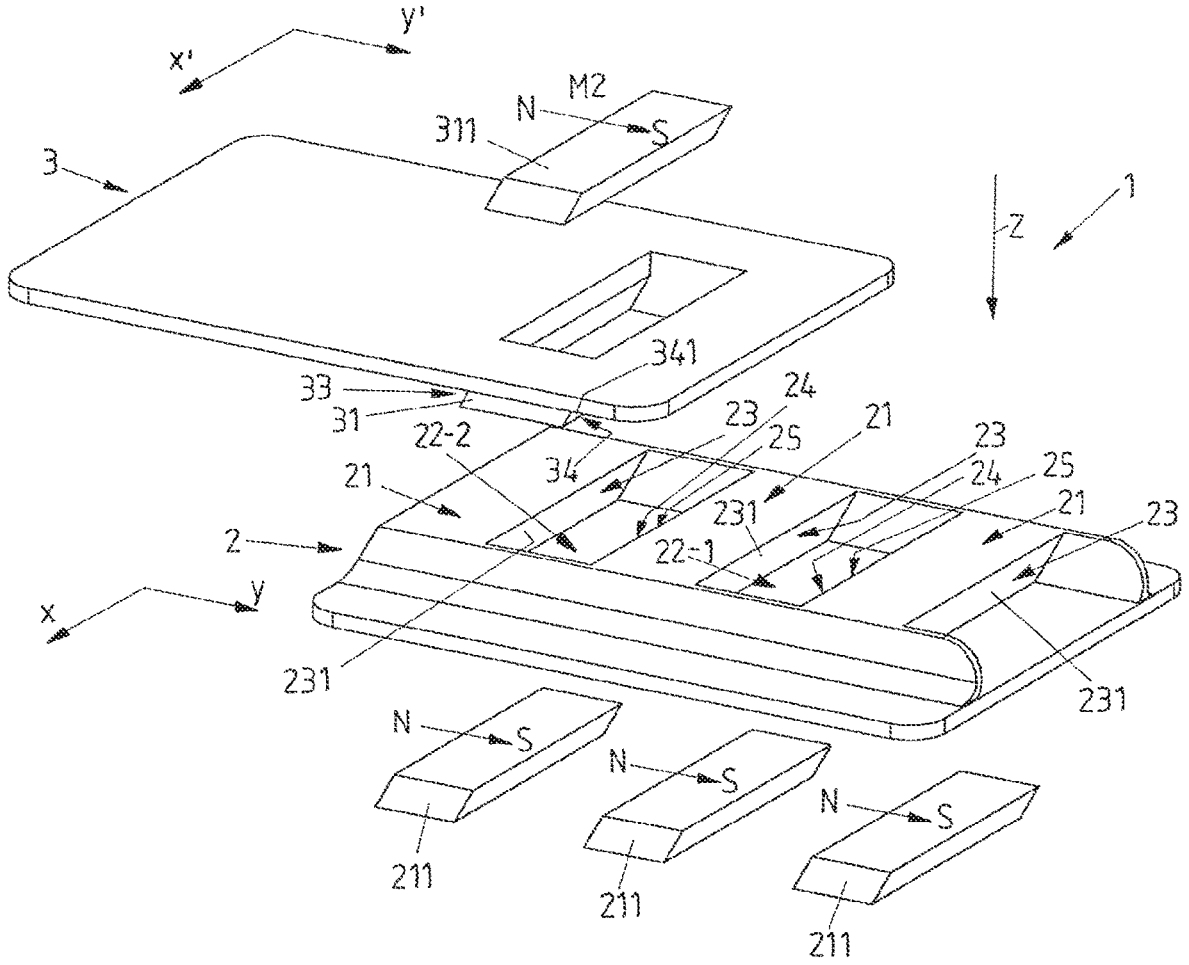
FIG. 2A a perspective exploded view of a sample embodiment of a closure device with engaging sections having a cross section in the form of a parallelogram.
Figure 2B:
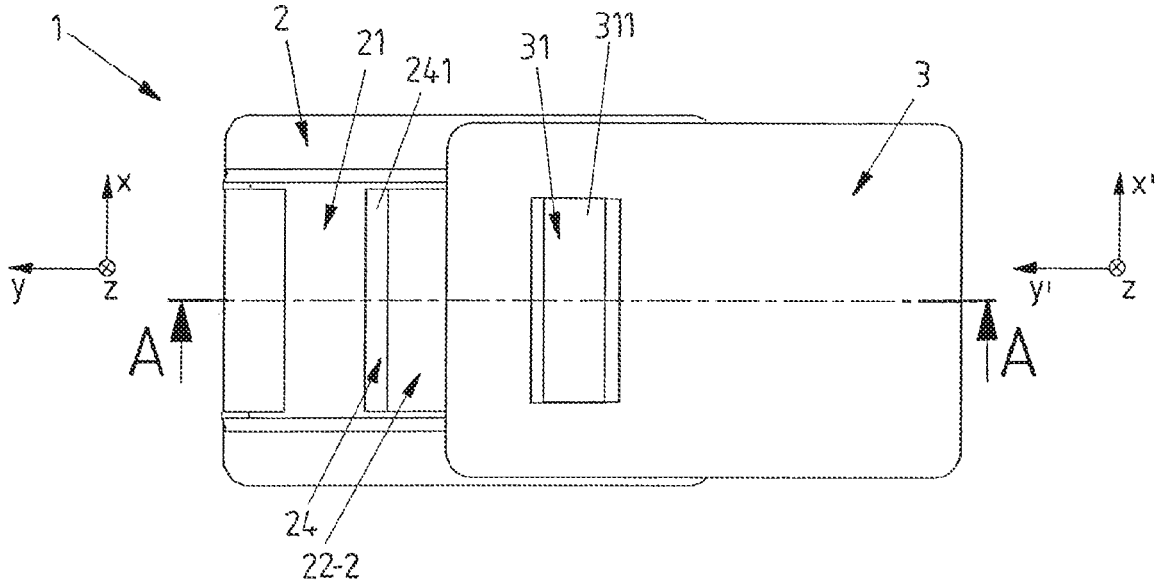
FIG. 2B-2D front views and cross-sectional views of the closure device from FIG. 2A.
Figure 2C:
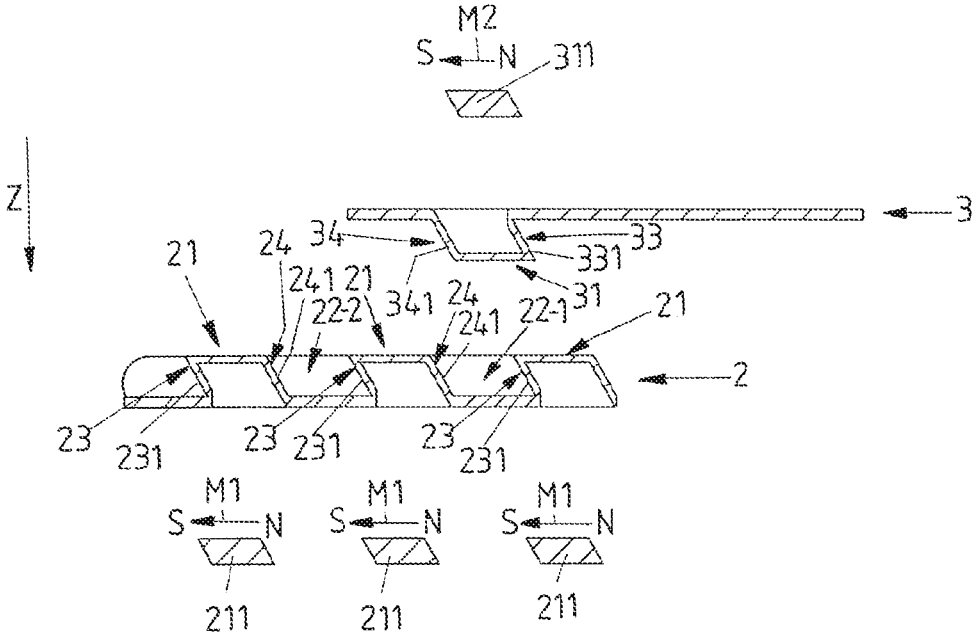
Figure 2D:
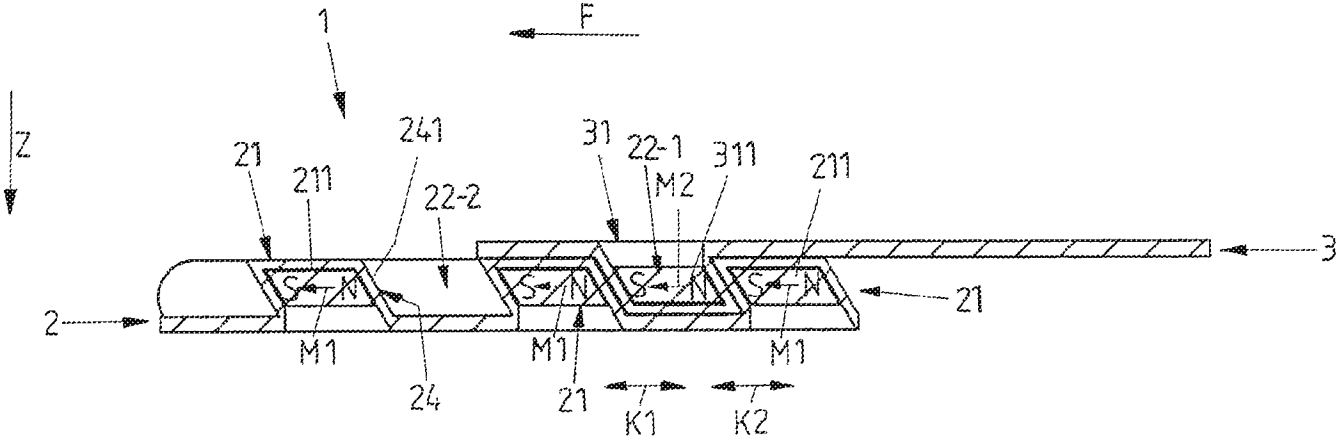
Figure 3:
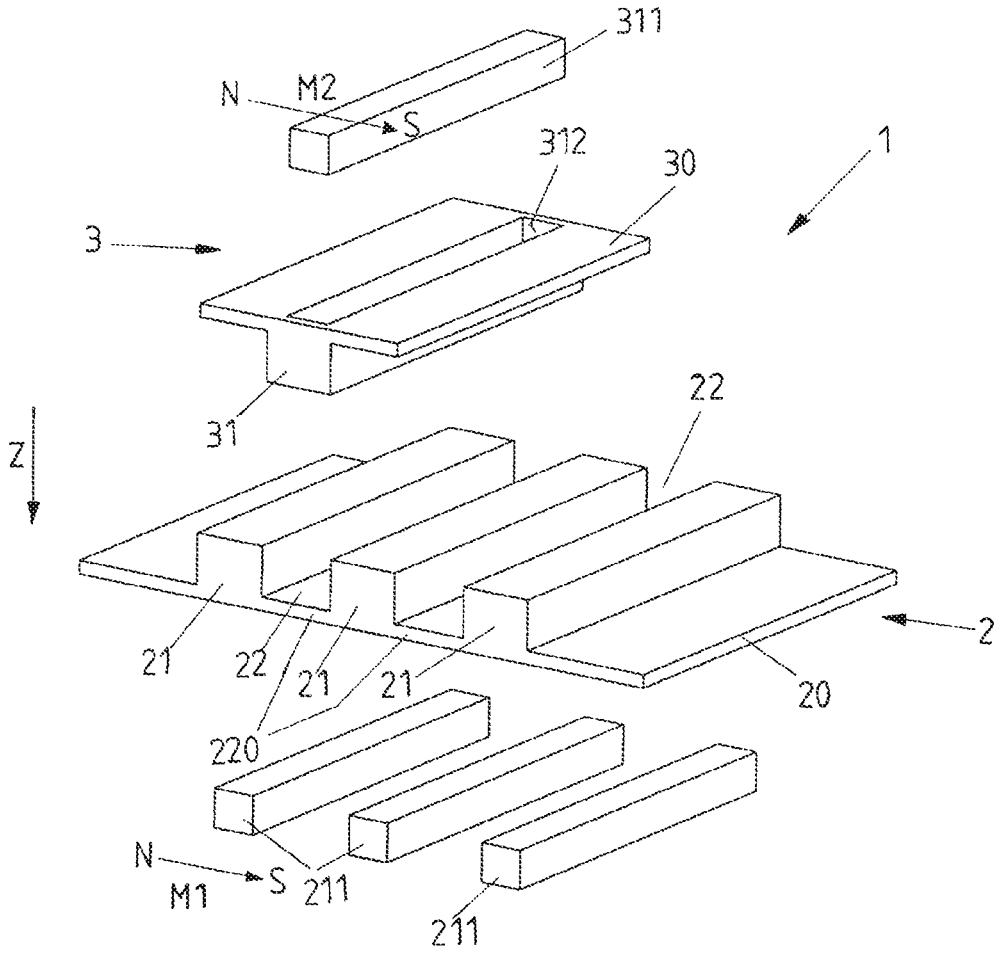
FIG. 3 a perspective exploded view of another sample embodiment of a closure device.
Figure 4:
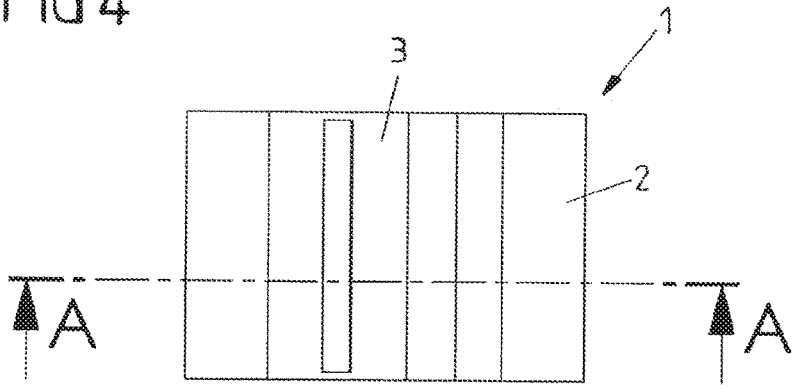
FIG. 4 a top view of the closure device.

FIG. 2A shows in a perspective exploded view a second sample embodiment of a closure device 1 according to the invention. FIG. 2B represents the closure device 1 of FIG. 2A in a front view. FIG. 2C shows a corresponding cross-sectional representation along the sectioning line A-A shown in FIG. 2B. FIG. 2D shows a cross-sectional representation of the closure device 1 according to the second sample embodiment in its closed position.

The closure device 1 represented in FIG. 2A to 2D has a similar basic structure and function to the closure device 1 described in regard to FIG. 1A to 1I. Thus, the above given description of the first sample embodiment also holds basically for the second sample embodiment per FIG. 2A to 2D.

In contrast with the first sample embodiment, however, in the closure device 1 per FIG. 2A to 2D both the engaging sections 21, 31 and the permanent magnets 211, 311 arranged therein have a cross section in the form of a non-rectangular parallelogram (see in particular FIGS. 2C and 2D). The first form fit sections 23 and the second form fit sections 33 are each formed by a surface of an engaging section 21, 31 which is slanted to the closing direction Z.

This has the following advantage, especially in a cascading configuration with at least three first engaging sections 21 and at least two gaps 22 resulting from them (as in the sample embodiment per FIG. 2A to 2D): if the second closure part 3 is moved from a first closed position, in which it is received by a first gap 22-1, into a second closed position, in which it is received by a second gap 22-2, this may occur by a force F applied along a perpendicular to the closing direction Z without the closure device 1 having to be first opened with a force acting against the closing direction Z, since the side surfaces of the engaging sections 21, shaped as a parallelogram in cross section, divert the force F appropriately. Thus, the closure device 1 works like a freewheeling, which blocks in one direction and can be easily moved in the other direction. An opening of the closure device 1 can also occur in especially simple manner in this way.

The base bodies 20, 30 of the closure parts 2, 3 in the sample embodiment per FIGS. 1 and 2 are made entirely or partly of a flexible material, especially a thermoplastic elastomer or a synthetic rubber. The base bodies 20, 30 are therefore flexibly deformable at least for a portion.

In particular, the engaging sections 21, 31 can be made from such a flexible material.

In addition or alternatively, other sections, especially an intermediate section between adjacent engaging sections 21 of the first closure part 2, may also be made from a flexible material.

By manufacturing the base bodies 20, 30 of the closure parts 2, 3 at least in part from a flexible material one achieves a deformability at the closure parts 2, 3, making it possible on the one hand to secure the closure parts 2, 3 in variable manner with shape adapted to a mating object, such as an article of clothing or the like. On the other hand, the use of a flexible material can also achieve an advantageous connecting effect and a favorable holding of the closure parts 2, 3 against each other in the closed position, thanks to a beneficial adhesive friction between the engaging sections 21, 31 in the closed position.

Figure 5A:
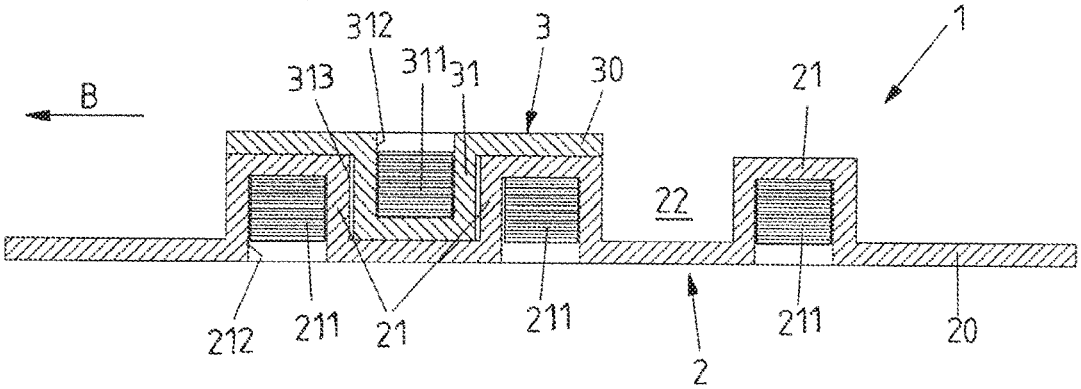
FIG. 5A a cross-sectional view along line A-A of FIG. 4, in a closed position of the closure device.
Figure 5B:
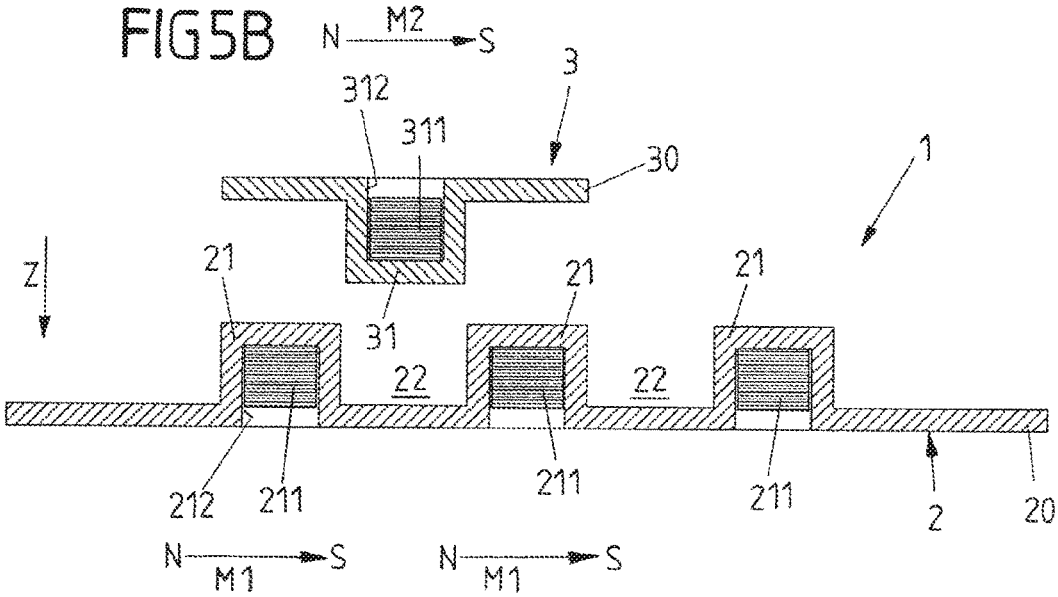
FIG. 5B the cross-sectional view of FIG. 5A, for the opened closure device.
Figure 6:
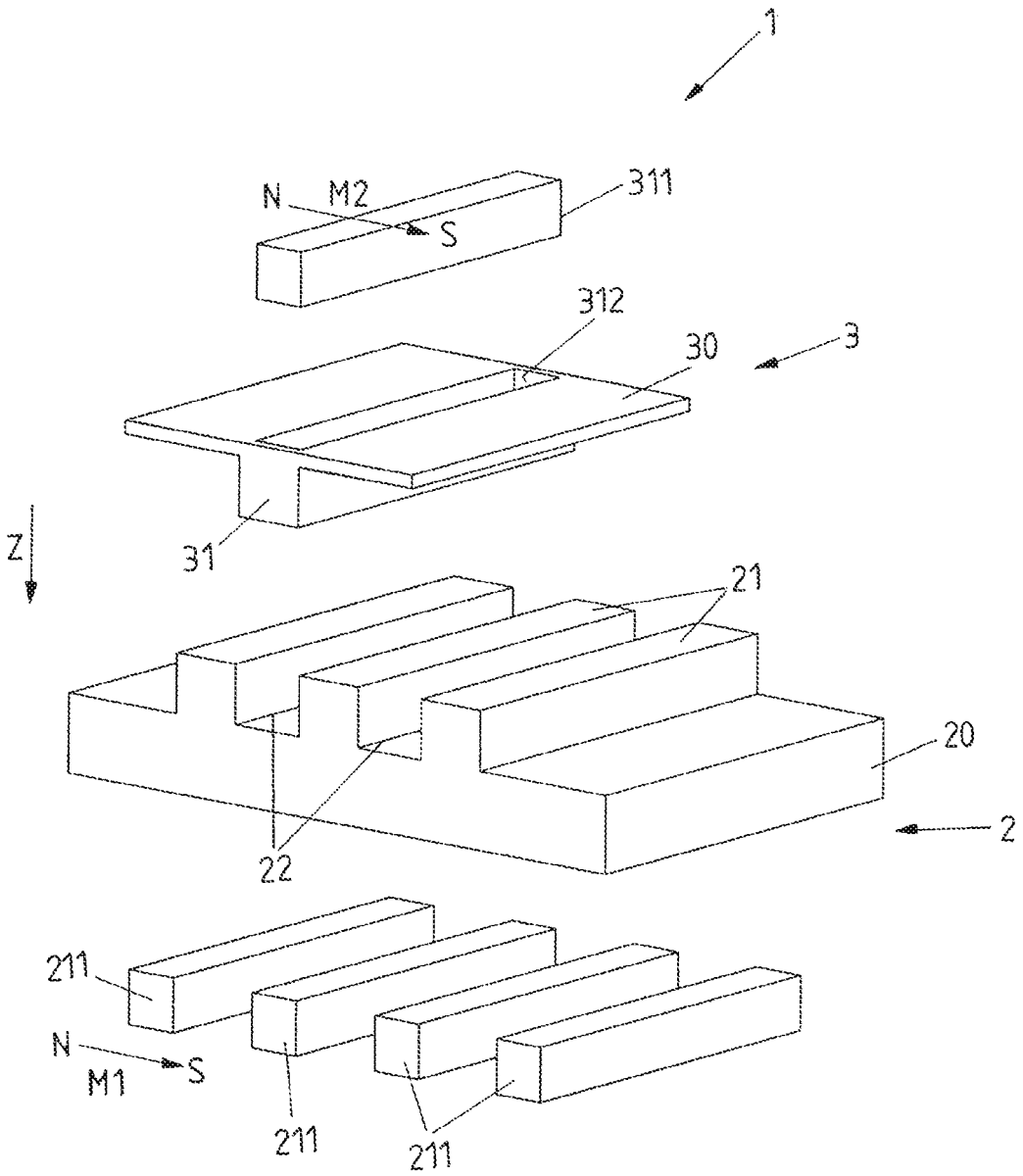
FIG. 6 a perspective exploded view of another sample embodiment of a closure device.
Figure 7:
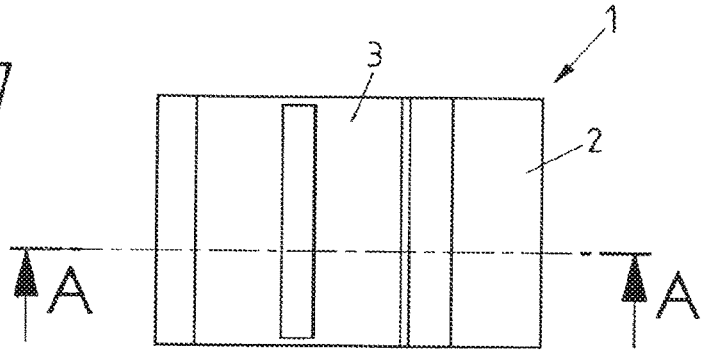
FIG. 7 a top view of the closure device.
Figure 8A:
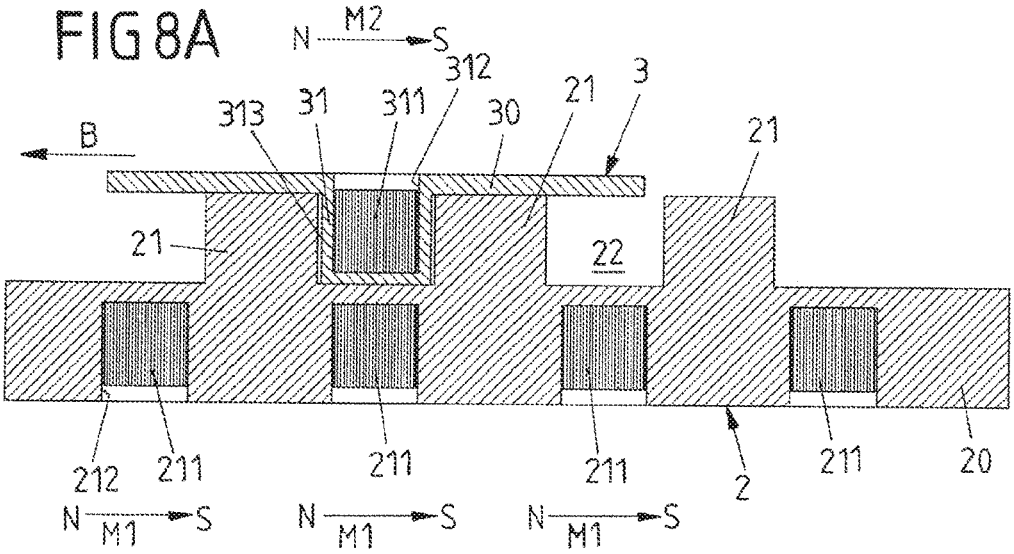
FIG. 8A a cross-sectional view of the closure device along line A-A of FIG. 7, in a closed position of the closure device.
Figure 8B:
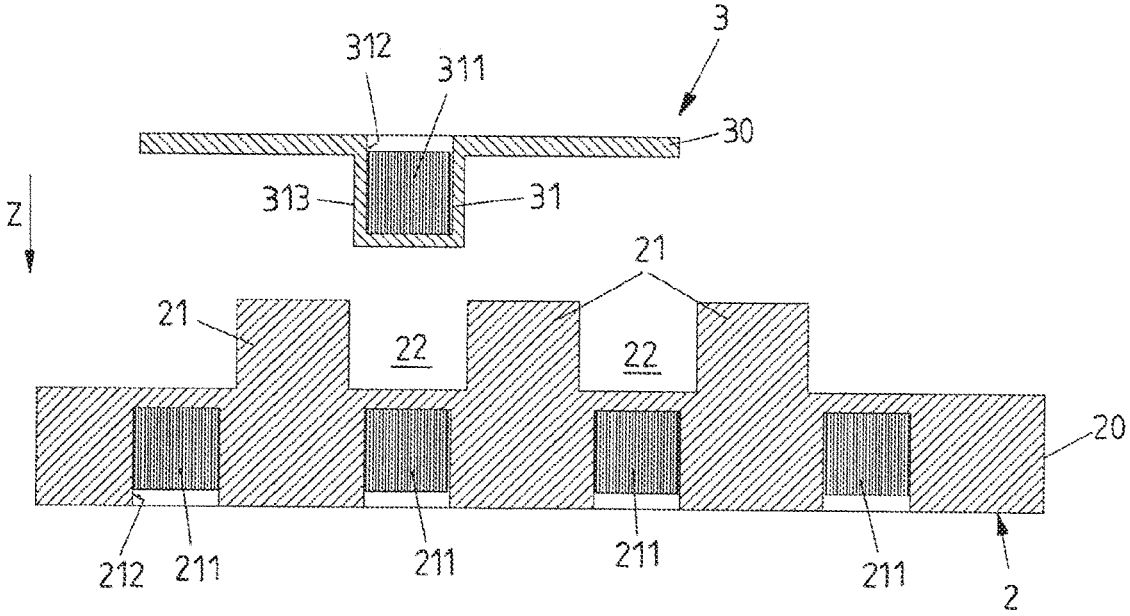
FIG. 8B the cross-sectional view of FIG. 8A, for the opened closure device.

In one sample embodiment represented in FIGS. 3 to 5A, 5B, three engaging sections 21 set off from each other are arranged on a base body 20 of a first closure part 2 along a loading direction B, extending in the form of webs transversely to the loading direction B on the base body 20. On a base body 30 of a second closure part 3 there is formed an engaging section 31 in the shape of a web, which is complementary to a gap 22 between two adjacent engaging sections 21 of the first closure part 2 and is received with form fit between the adjacent engaging sections 21 in a closed position (FIG. 5A).

In each engaging section 21, 31 of the closure parts 2, 3 in the sample embodiment represented there is arranged a magnetic section in the form of a discrete magnet element 211, 311, being magnetized as described above with respect to FIGS. 1 and 2 in collinear manner to the loading direction B and thus producing in the closed position a magnetic force of attraction between the engaging sections 21, 31 substantially along the loading direction B.

For the closing of the closure device 1, the engaging section 31 of the second closure part 3 is inserted in one of the gaps 22 between the engaging sections 21 of the first closure part 2 and moved closer to the first closure part 2 in a closing direction Z. In the closed position (FIG. 5A), the engaging section 31 of the second closure part 3 is received in one of the gaps 22, whereupon thanks to the magnetic attraction and under a loading in the loading direction B an (adhesive) friction exists across a bearing surface 313 in abutment with one of the engaging sections 21, by virtue of which the closure parts 2, 3 are held against each other with positive and non-positive locking.

The base bodies 20, 30 in turn are made at least in part of a flexible material and thus are deformable, wherein furthermore an advantageous adhesive friction can be achieved through the choice of the material, even under a large loading.

In a modified sample embodiment, represented in FIGS. 6 to 8A, 8B, magnet elements 211 of the first closure part 2 are arranged beneath the gaps 22 (and therefore not inside the engaging sections 21, as in the sample embodiment per FIGS. 3 to 5A, 5B). The magnetic attraction between the closure parts 2, 3 thus acts in particular in the perpendicular direction along the closing direction Z, wherein the magnetic sections 211, 311 of the closure parts 2, 3, realized for example by discrete magnet elements, can be magnetized similar to the sample embodiment per FIGS. 1 and 2 and the sample embodiment per FIGS. 3 to 5A, 5B. Alternatively, however, the magnetic sections 211, 311 may also be magnetized along the closing direction Z, so that one pole of one magnetic section 211 of the first closure part 2, associated with one gap 22, stands opposite an unlike pole of the magnetic section 311 of the second closure part 3 in magnetic attraction (along the closing direction Z).

Furthermore, reference is made to the above remarks, especially for the sample embodiment of FIGS. 3 to 5A, 5B.

In a sample embodiment represented in FIGS. 9 to 11A-11D, the base bodies 20, 30 of the closure parts 2, 3 are formed curved in a plane subtended by the closing direction Z and the loading direction B (corresponding to the plane of the drawing in FIG. 11A to 11D), so that the engaging sections 21 of the first closure part 2 are lined up against each other along a curved direction.

In this case, the base bodies 20, 30 can each be made of a flexible material at least in part. Alternatively, however, it is also conceivable to make the base bodies 20, 30 from a rigid material, i.e., a material which is slightly deformable, if at all, and therefore not flexibly adaptable to the shape of an article of clothing or the like, for example.

In the sample embodiment represented, two gaps 22 are provided on the first closure part 2, formed between three engaging sections 21, into which one engaging section 31 of the second closure part 3 can be inserted in the closing direction Z, as can be seen in the transition from FIG. 11A to FIG. 11D.

The engaging sections 21, 31 each have the basic shape of a non-rectangular parallelogram in cross section, so that a bearing surface 313 of the engaging section 31 of the second closure part 3 is inclined both to the closing direction Z and to the loading direction B and therefore in the closed position (FIG. 11D) is in self-reinforcing abutment with a mating engaging section 21 of the first closure part 2. The inclination of the bearing surface 313 in particular means that, under loading in the loading direction B at the second closure part 3, a force component acts by force diversion on the engaging section 31 of the second closure part 3 in the direction of an engagement with the gap 22 between the engaging sections 21 of the first closure part 2, so that the engagement is additionally secured under loading.

Figure 11A:
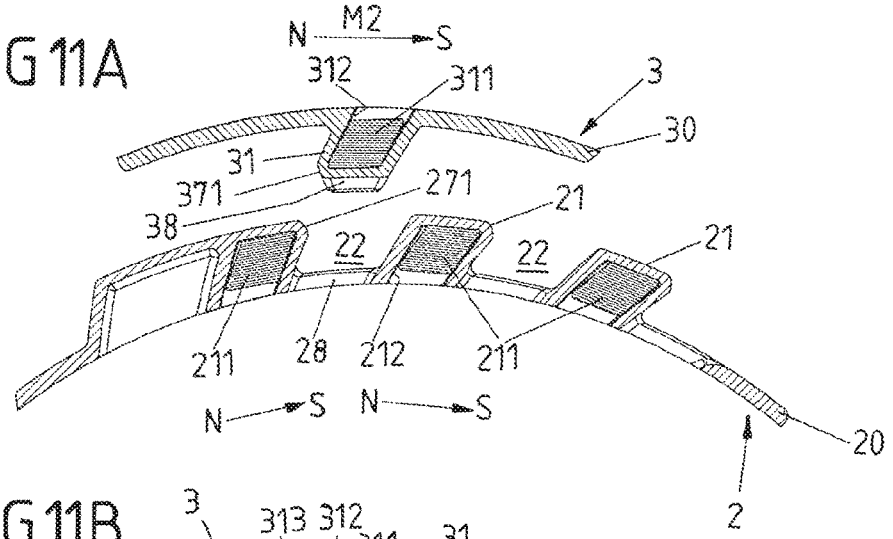
FIG. 11A a cross-sectional view along line A-A of FIG. 10, for the opened closure device.
Figure 11B:
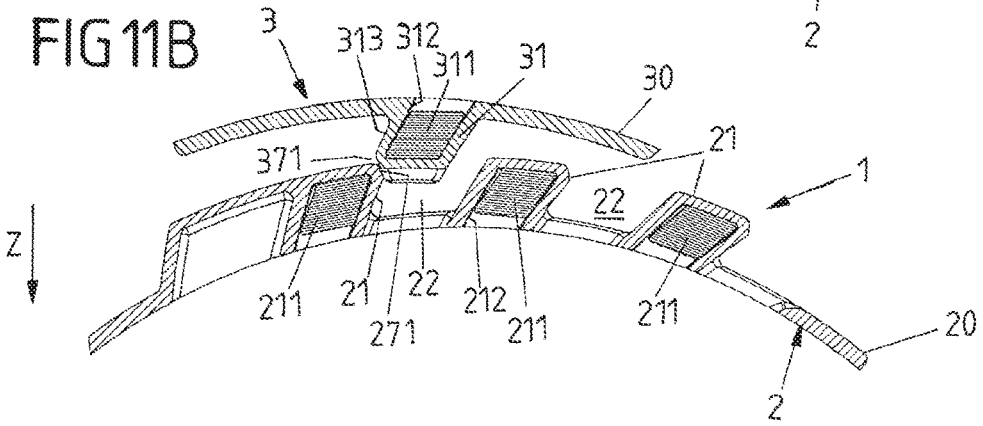
FIG. 11B a front view of the closure device upon closing.
Figure 11C:
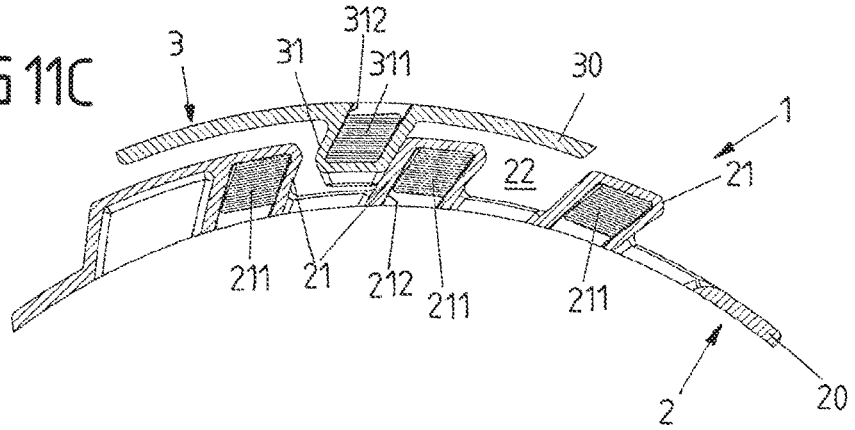
FIG. 11C a front view of the closure device upon further closing.
Figure 11D:
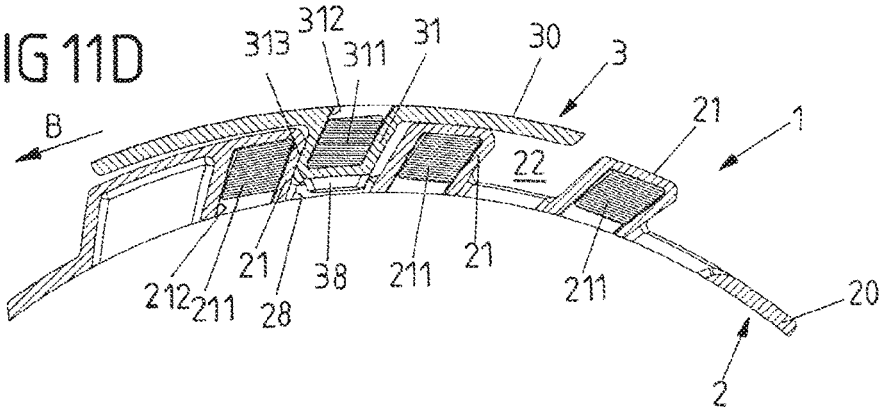
FIG. 11D a cross-sectional view of the closure device along line A-A of FIG. 10, for the closed closure device.
Figure 12:
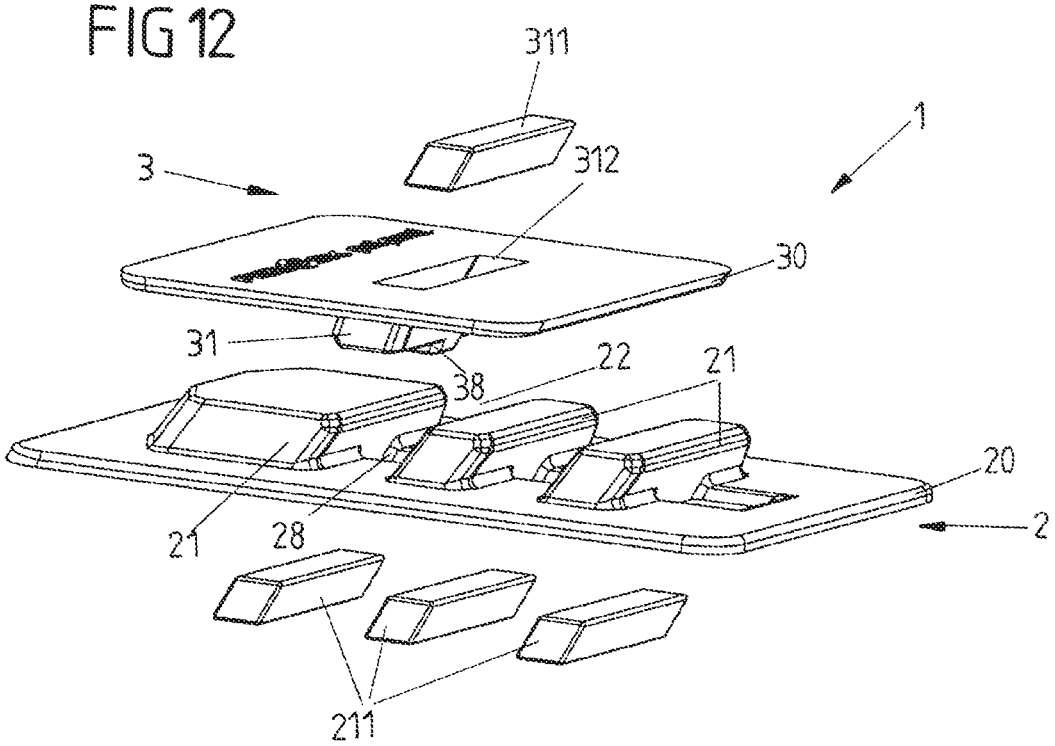
FIG. 12 a perspective exploded view of another sample embodiment of a closure device.
Figure 13:
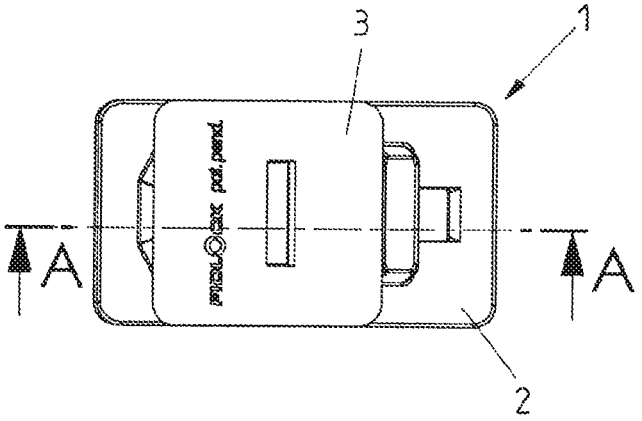
FIG. 13 a top view of the closure device.
Figure 14A:
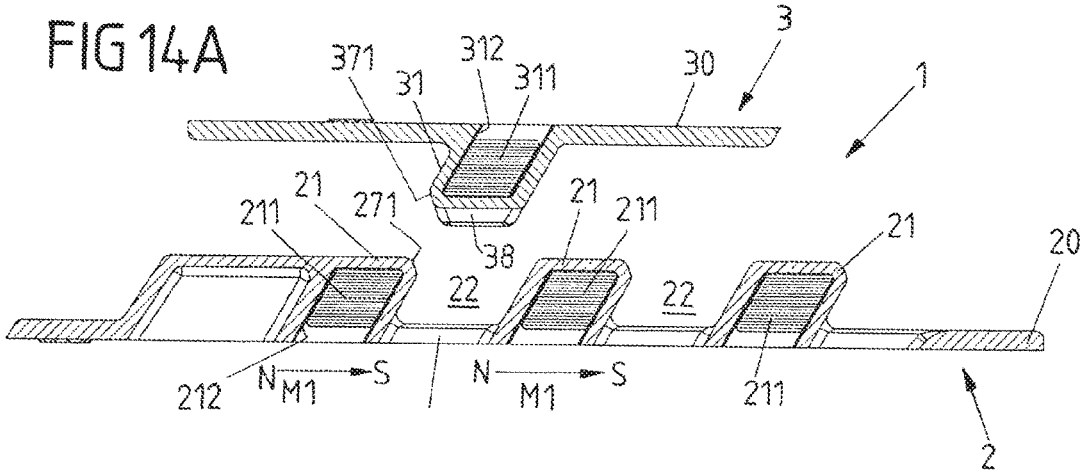
FIG. 14A a cross-sectional view along line A-A of FIG. 13, for the opened closure device.
Figure 14B:
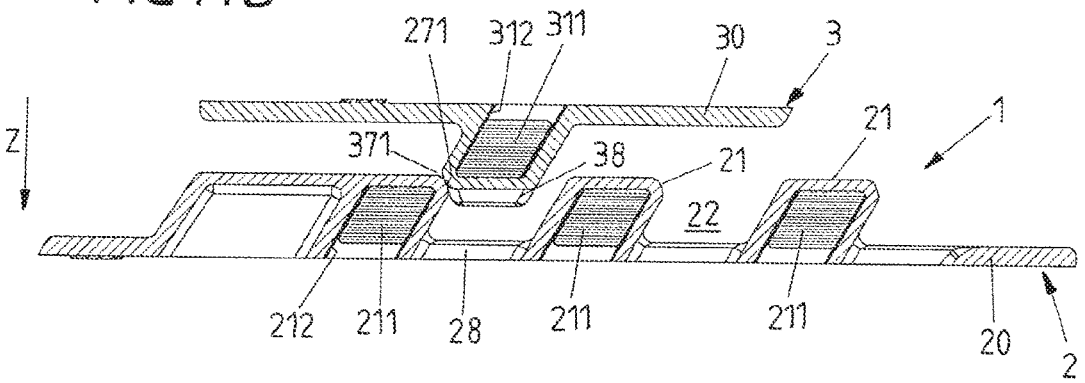
FIG. 14B a front view of the closure device upon closing.
Figure 14C:
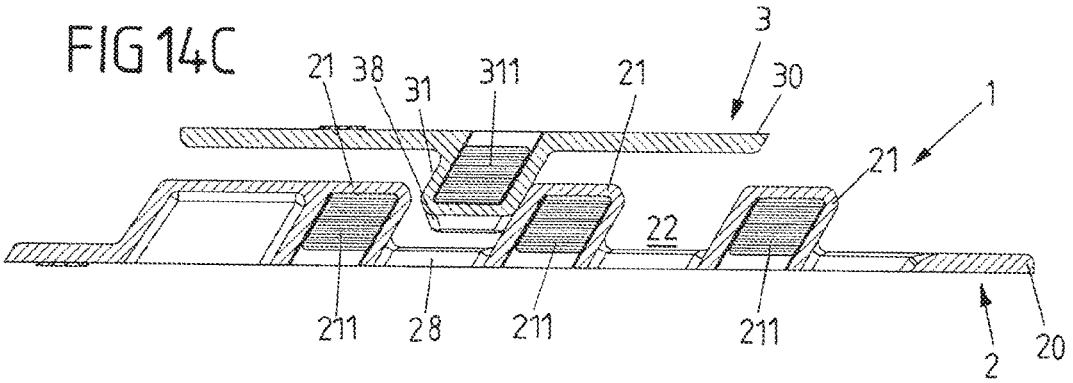
FIG. 14C a front view of the closure device upon further closing.
Figure 14D:
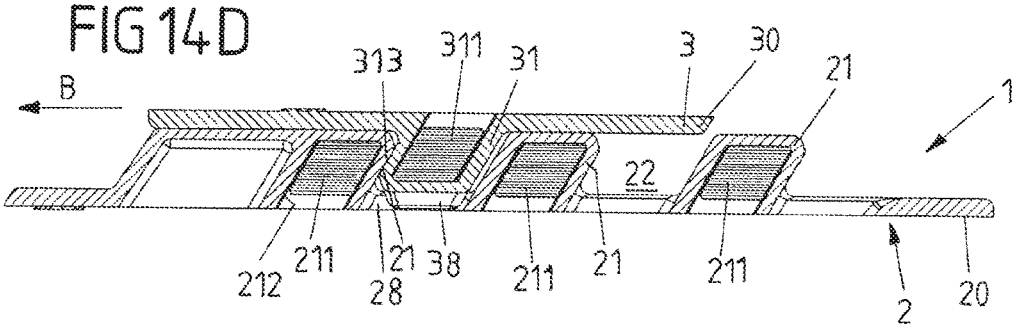
FIG. 14D a cross-sectional view of the closure device along line A-A of FIG. 13, in the closed position of the closure device.
Figure 15:
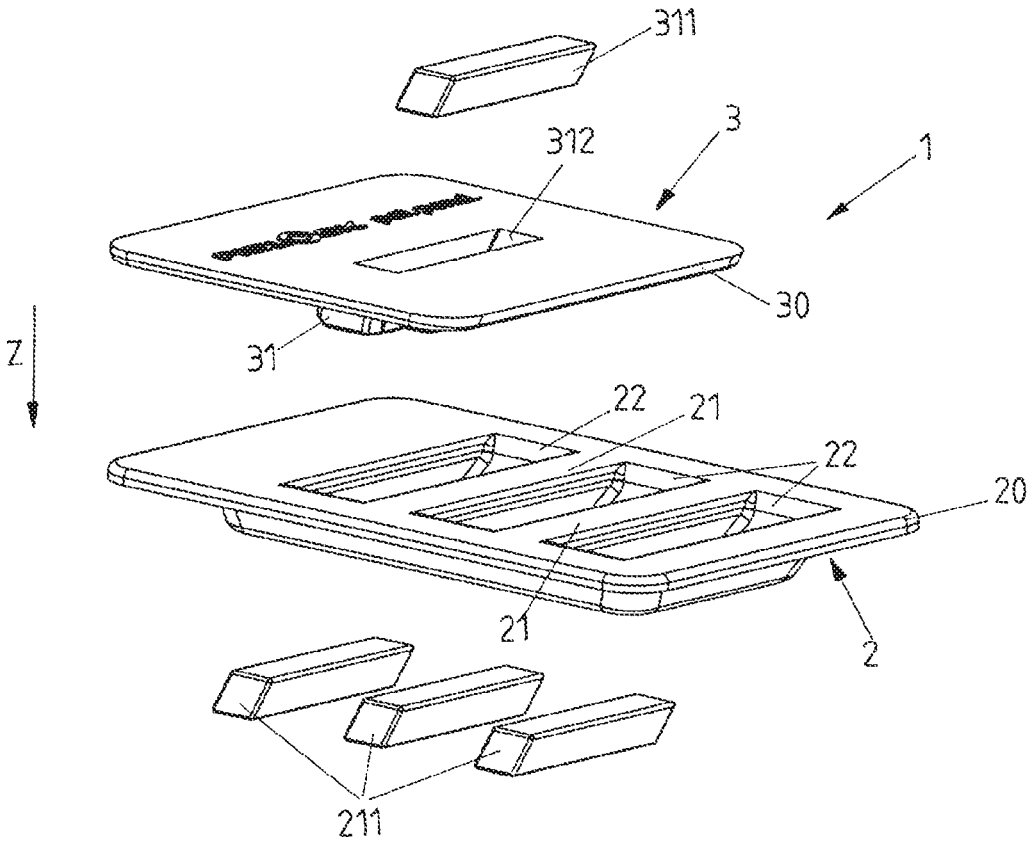
FIG. 15 a perspective exploded view of another sample embodiment of a closure device.
Figure 16:
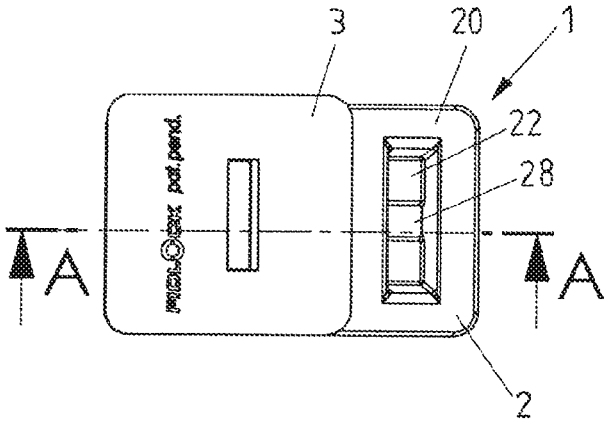
FIG. 16 a top view of the closure device.
Figure 17A:
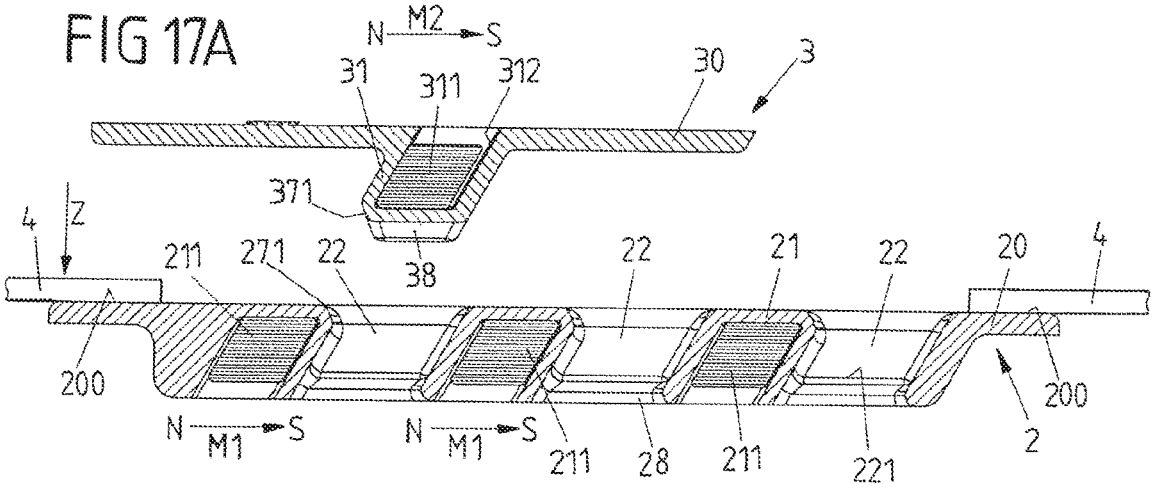
FIG. 17A a cross-sectional view along line A-A of FIG. 16, for the opened closure device.
Figure 17B:
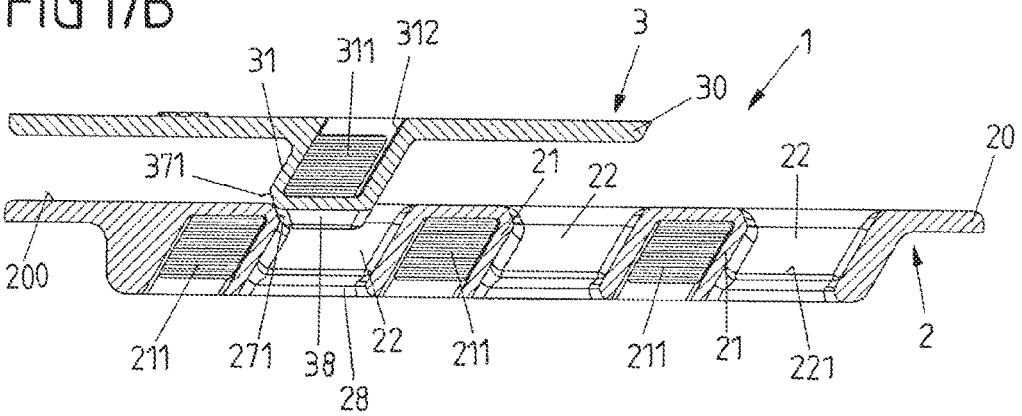
FIG. 17B a front view of the closure device upon closing.
Figure 17C:
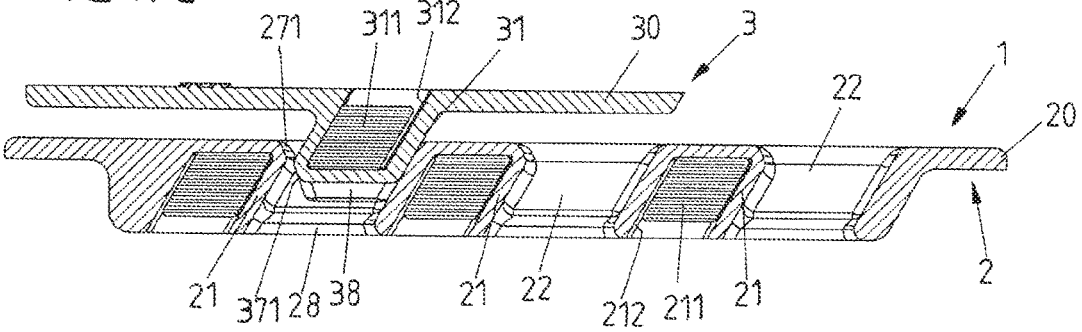
FIG. 17C a front view of the closure device upon further closing.
Figure 17D:
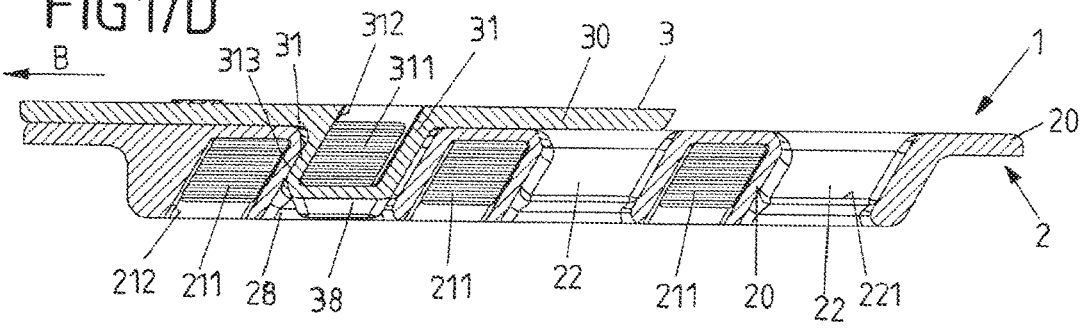
FIG. 17D a cross-sectional view along line A-A of FIG. 16, in the closed position of the closure device.

As is evident from FIGS. 11A and 11B, the engaging section 31 of the second closure part 3 has at one edge a guiding section 371 in the form of a leading bevel, which comes to abut against a guiding section 271 in the form of a leading bevel on one of the engaging sections 21 of the first closure part 2 when the closure parts 2, 3 are placed against each other, thereby producing a guidance of the engaging section 31 of the second closure part 3 in engagement with a gap 22 of the first closure part 2.

Figure 9:
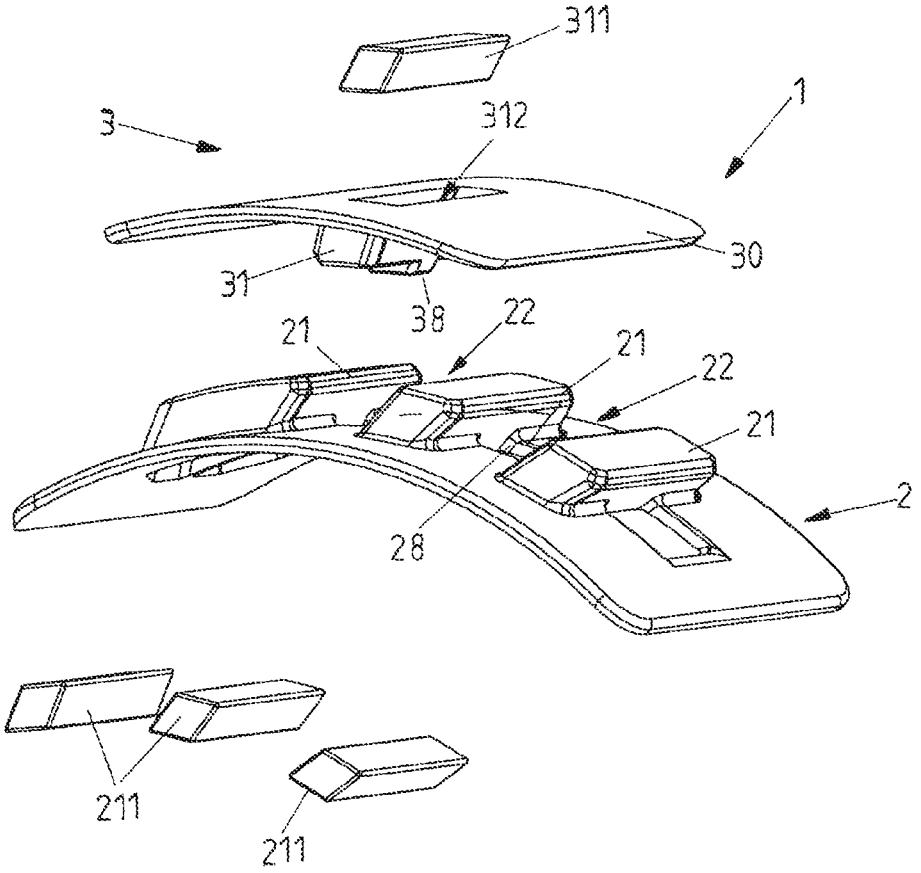
FIG. 9 a perspective exploded view of another sample embodiment of a closure device.
Figure 10:
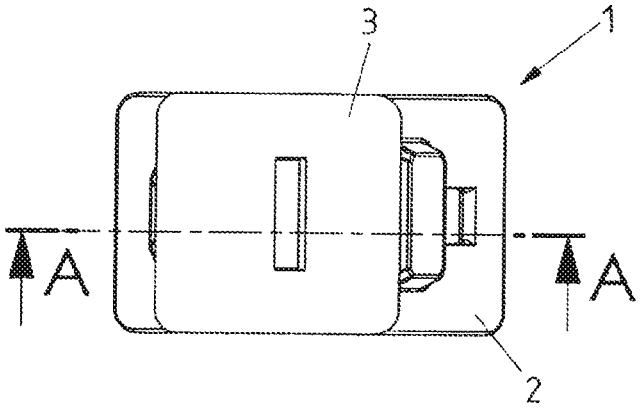
FIG. 10 a top view of the closure device.

On the underside of the engaging section 31 of the second closure part 3 there is formed a protruding element 38, as can be seen from a joint viewing of FIG. 11A and FIG. 9, which comes into engagement with a mating recess 28 at the bottom of a gap 22 when closing the closure device 1 and thereby positions the engaging section 31 within the gap 22 in a definite manner, as is evident from FIG. 11B. Thanks to the engagement of the protruding element 38 with the recess 28, the engaging section 31 therefore takes up a defined position within the gap 22, in which the bearing surface 313 is in abutment with a mating engaging section 21 (in FIG. 11DD to the left of the bearing surface 313).

The sample embodiment represented in FIGS. 12 to 14A-14D is basically functionally identical to the sample embodiment of FIGS. 9 to 11A-11D, wherein in this case the base bodies 20, 30 are not curved, viewed in the plane subtended by the closing direction Z and the loading direction B, corresponding to the plane of the drawing per FIG. 14A to 14D. In this case, the base bodies 20, 30 are each preferably made at least in part from a flexible material.

In other respects, for the functioning of the closure device 1 of this sample embodiment reference is made to the foregoing remarks on the sample embodiment per FIGS. 9 to 11A-11D.

In a sample embodiment represented in FIGS. 15 to 17A-17D, as a modification of the sample embodiment per FIGS. 12 to 14A-14D, the gaps 22 between the engaging sections 21 of the first closure part 2 are sunken in the base body 20, the bottoms 221 of the gaps 22 being recessed with respect to a fastening section 200 by which a part 4, such as a textile section of an article of clothing, can be connected to the base body 20, for example by stitching or gluing.

In particular, in this sample embodiment the engaging sections 21 of the first closure part 2 do not extend outwardly beyond the fastening section 200 (against the closing direction Z), so that the engaging sections 21 are sunken in the base body 20.

Otherwise, this sample embodiment is functionally identical to the sample embodiments of FIGS. 9 to 12A-12D and FIGS. 13 to 15A-15D, so that reference is made to the preceding remarks.

Figure 18:
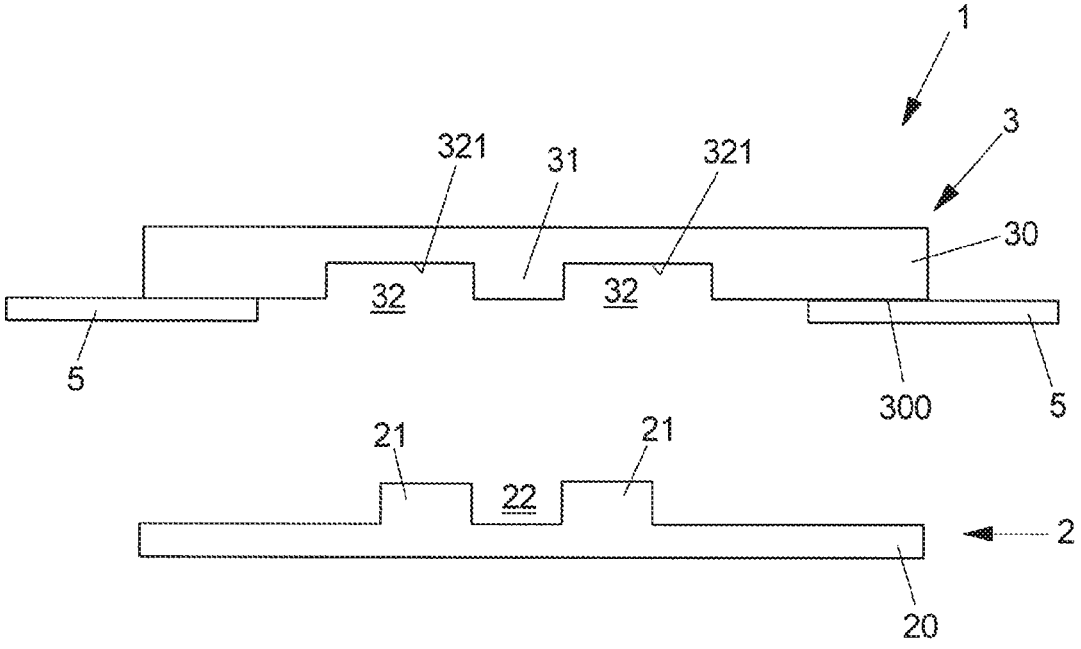
FIG. 18 a sketch of yet another sample embodiment of a closure device.

In a modification of the sample embodiment per FIGS. 15 to 17A-17D, as shown schematically in FIG. 18, the engaging section 31 of the second closure part 3 may alternatively be sunken in the base body 30, in that the engaging section 31 does not protrude outwardly beyond a fastening section 300—on which a part 5 may be secured, such as a textile section of an article of clothing—and the bottoms 321 of gaps (depressions) 32 adjacent to the engaging section 31 are recessed in relation to the fastening section 300.

In another modification, it is also conceivable and possible to provide a fastening section 200, 300 on each closure part 2, 3, relative to which the bottoms 221, 321 of the gaps 22, 32 are recessed, so that the gaps 22, 32 are formed as a kind of depression in the respective base body 20, 30.

The basic idea of the invention is not confined to the above described sample embodiments, but rather may also be realized in an entirely different way.

A closure device of the kind described here may be used in very different manners, for example, on an article of clothing, such as a shoe, a jacket, a shirt, or the like.

In one specific embodiment, a shoe, especially an athletic shoe, has a closure device of the kind described here. The closure device serves, e.g., to close and possibly tighten the shoe, (such as a ski boot).

However, such a closure device may also be used for example on a medical aid, such as an orthesis or a prosthesis.

As the magnetic sections, discrete magnet elements may be used, for example, which are for example inserted in associated recesses on the base body and glued to the base body, for example by using an epoxy glue.

The magnetic sections may be formed each time by a permanent magnet element. Alternatively, it is also conceivable to provide permanent magnet elements on one closure part, for example, but passive magnet elements in the form of ferromagnetic anchors on the other closure part, interacting by magnetic attraction with the permanent magnets.

Again, alternatively, it is also conceivable to produce the base body of the closure parts themselves at least partly of a magnetized material, instead of discrete elements.

LIST OF REFERENCE SYMBOLS

1 Closure device
2 First closure part
20 Base body of the first closure part
200 Fastening section
21 First engaging section
211 First permanent magnet
212 Receiving opening
22, 22-1, 22-2 Gaps
220 Intermediate section
23 First form fit section
231 First form fit surface
24 First guiding section
241 First guiding surface
25 First bearing section
26 Second bearing section
27 Second guiding section
271 Second guiding surface
28 Form fit section
3 Second closure part
30 Base body of the second closure part
300 Fastening section
31 Second engaging section
311 Second permanent magnet
312 Receiving opening
313 Bearing surface
32 Gap
321 Bottom
33 Second form fit section
331 Second form fit surface
34 First guiding section
341 First guiding surface
35 First bearing section
36 Second bearing section
37 Second guiding section
371 Second guiding surface
38 Form fit section

4, 5 Parts
B Loading direction
F Force
K1, K2 Magnetic forces
M1 First direction of magnetization
M2 Second direction of magnetization
N North pole
R1, R2 Relative movements
S South pole
XY, X'Y' Planes of extension of the base body
Z Closing direction

The invention claimed is:

1. A closure device for the releasable connecting of two parts to each other, with a first closure part, having a first base body, at least two first engaging sections formed on the first base body, spaced apart from each other along a loading direction and forming between them a gap, and at least one first magnetic section arranged on the first base body, and a second closure part, having a second base body, at least one second engaging section formed on the second base body, and at least one second magnetic section arranged on the second base body, wherein the first closure part and the second closure part are placeable against each other such that, in a closed position, the at least one second engaging section is received at least partly by the gap for the bracing of a loading acting between the first closure part and the second closure part along the loading direction, wherein in the closed position the at least one first magnetic section and the at least one second magnetic section interact by magnetic attraction, and wherein at least one of the first base body and the second base body are made at least partly from a flexible material, wherein the at least one second engaging section has a bearing surface, which in the closed position is in abutment with one of the at least two first engaging sections for the bracing of a loading acting in the loading direction on the second closure part, and wherein the bearing surface is inclined to the loading direction and to a closing direction, along which the first closure part and the second closure part may be placed against each other, such that, under a loading against the second closure part in the loading direction, the bearing surface of the at least one second engaging section is configured to provide a force component in the closing direction relative to the first closure part to prevent the first and second closure parts from separating.

2. The closure device according to claim 1, wherein the at least two first engaging sections of the first base body and/or the at least one second engaging section of the second base body are made of a flexible material.

3. The closure device according to claim 1, wherein an intermediate section of the first base body between the at least two first engaging sections of the first base body is made of a flexible material.

4. The closure device according to claim 1, wherein the flexible material comprises a thermoplastic elastomer or a synthetic rubber material.

5. The closure device according to claim 4, wherein the flexible material comprises a thermoplastic polyurethane, or a acrylonitrile-butadiene rubber.

6. The closure device according to claim 1, wherein the flexible material comprises fibers.

7. The closure device according to claim 6, wherein the flexible material comprises glass fibers in a fraction of less than 15 wt. percent.

8. The closure device according to claim 1, wherein the at least two first engaging sections and/or the at least one second engaging section extend in the form of webs transversely to the loading direction.

9. The closure device according to claim 1, wherein the at least one first magnetic section is formed by a magnetic element which is received in a receiving opening of the first base body, and/or in that the at least one second magnetic section is formed by a magnet element which is received in a receiving opening of the second base body.

10. The closure device according to claim 1, wherein a first magnetic section is arranged within each of the at least two first engaging sections and/or a second magnetic section is arranged within the at least one second engaging section.

11. The closure device according to claim 1, wherein the at least one first magnetic section and/or the at least one second magnetic section are magnetized along a direction of magnetization which is collinear with the loading direction.

12. The closure device according to claim 1, wherein at least one of the first base body and the second base body are curved, viewed along the loading direction.

13. The closure device according to claim 1, wherein the first base body is connectible to a first part and the second base body to a second part, wherein at least one of the first base body comprises a first fastening section, by which the first base body is to be connected to the first part, wherein the first fastening section defines a plane extending along the loading direction, relative to which a bottom of the gap is recessed, and the second base body comprises a second fastening section, by which the second base body is to be connected to the second part, wherein the second fastening section defines a plane extending along the loading direction, relative to which a bottom adjoining the at least one second engaging section is recessed.

14. The closure device according to claim 1, wherein the first closure part comprises more than two first engaging sections, which are evenly spaced apart from each other along the loading direction, wherein every two adjacent ones of the first engaging sections form between them a gap, which is configured to at least partly receive the at least one second engaging section in the closed position.

15. An article of clothing, including a shoe, jacket or shirt, with the closure device according to claim 1.

* * * * *